US007934713B2

(12) United States Patent
Suzuki et al.

(10) Patent No.: US 7,934,713 B2
(45) Date of Patent: May 3, 2011

(54) SHEET ALIGNMENT MECHANISM, SHEET POST-PROCESSING APPARATUS, AND IMAGE FORMING APPARATUS

(75) Inventors: Nobuyoshi Suzuki, Tokyo (JP); Masahiro Tamura, Kanagawa (JP); Shuuya Nagasako, Kanagawa (JP); Kazuhiro Kobayashi, Kanagawa (JP); Shohichi Satoh, Kanagawa (JP); Akira Kunieda, Tokyo (JP); Tomoichi Nomura, Aichi (JP); Hiroshi Maeda, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 483 days.

(21) Appl. No.: 11/836,873

(22) Filed: Aug. 10, 2007

(65) Prior Publication Data

US 2008/0211162 A1 Sep. 4, 2008

(30) Foreign Application Priority Data

Aug. 11, 2006 (JP) ..... 2006-220470
May 28, 2007 (JP) ..... 2007-140973

(51) Int. Cl.
*B65H 37/04* (2006.01)

(52) U.S. Cl. ..... 270/58.12; 270/58.07; 270/58.08; 270/58.11; 270/58.17; 270/58.27

(58) Field of Classification Search ..... 270/58.07, 270/58.08, 58.09, 58.11, 58.12, 58.17, 58.27
See application file for complete search history.

(56) References Cited

U.S. PATENT DOCUMENTS

| | | | | |
|---|---|---|---|---|
| 5,263,697 | A * | 11/1993 | Yamazaki et al. | 270/58.08 |
| 5,447,297 | A * | 9/1995 | Murata et al. | 270/58.09 |
| 5,622,359 | A * | 4/1997 | Kawano et al. | 270/58.12 |
| 6,241,234 | B1 * | 6/2001 | Saitoh et al. | 270/58.12 |
| 6,264,194 | B1 * | 7/2001 | Hayashi et al. | 271/220 |
| 6,290,220 | B1 * | 9/2001 | Takehara et al. | 270/58.12 |
| 6,698,744 | B2 | 3/2004 | Yamada et al. | |
| 7,326,167 | B2 * | 2/2008 | Suzuki et al. | 493/444 |
| 7,510,177 | B2 * | 3/2009 | Nagata et al. | 270/58.08 |
| 7,654,511 | B2 * | 2/2010 | Nagata et al. | 270/58.11 |
| 2004/0254054 | A1 * | 12/2004 | Suzuki et al. | 493/405 |
| 2006/0055100 | A1 | 3/2006 | Suzuki et al. | |
| 2006/0202402 | A1 * | 9/2006 | Nagata et al. | 270/58.08 |
| 2006/0202403 | A1 * | 9/2006 | Nagata et al. | 270/58.11 |

FOREIGN PATENT DOCUMENTS

| | | |
|---|---|---|
| JP | 04-169292 | 6/1992 |
| JP | 05-170340 | 7/1993 |
| JP | 07-089645 | 4/1995 |
| JP | 08-067400 | 3/1996 |
| JP | 2000-327205 | 11/2000 |
| JP | 2001-171893 | 6/2001 |
| JP | 2004-093818 | 3/2004 |

* cited by examiner

*Primary Examiner* — Gene Crawford
*Assistant Examiner* — Leslie A Nicholson, III
(74) *Attorney, Agent, or Firm* — Harness, Dickey & Pierce, P.L.C.

(57) ABSTRACT

A sheet alignment mechanism includes a stacking tray on which a sheet or sheet bundle transported along a sheet transport path is stacked, a pair of side fences that are movable in a sheet width direction and align edges of the sheet or sheet bundle, stacked on the stacking tray, in the sheet width direction, a single drive source that moves the side fences, and detecting units that detect home positions of the respective side fences.

9 Claims, 36 Drawing Sheets

SHEET ALIGNMENT MECHANISM, SHEET POST-PROCESSING APPARATUS, AND IMAGE FORMING APPARATUS

CROSS-REFERENCE TO RELATED APPLICATIONS

The present application claims priority to and incorporates by reference the entire contents of Japanese priority documents, 2006-220470 filed in Japan on Aug. 11, 2006 and 2007-140973 filed in Japan on May 28, 2007.

BACKGROUND OF THE INVENTION

1. Field of the Invention

The present invention generally relates to an image forming apparatus, and specifically relates to a sheet alignment mechanism that aligns sheets after image formation.

2. Description of the Related Art

Conventionally, sheet post-processing apparatuses so called finishers have been known. One such sheet post-processing apparatus has been disclosed in Japanese Patent No. 2960770. The disclosed sheet post-processing apparatus includes a sheet alignment mechanism having a transport path along which a paper is transported, a stacking tray arranged at a predetermined angle in which sheets transported along the transport path are sequentially stacked, a pair of side fences that are symmetrically moved by a single drive source so as to align the sheets stacked on the stacking tray, and a stapler that staples a sheet bundle aligned in the stacking tray and detects, using a sensor, a home position, i.e., starting point, of one of the side fences.

Because the home position of the side fences is detected with one sensor, the structure is cost effective. However, if malfunction occurs in a drive system that moves the other one of the side fences not detected by the sensor or when the side fences are assembled with deviation, in many cases, sheets may not be aligned or may be stuck for some unknown reasons because no detecting unit is provided for such malfunction.

Furthermore, to move the side fences symmetrically with a single drive source, it may be configured such that the side fences are disposed symmetrically with respect to a drive pinion provided at the center and each of the side fences has a rack attached thereon to catch the pinion. Alternatively, the side fences may be fixed symmetrically on a timing belt placed in a sheet width direction. However, both of those structures suffer in that a gap between the side fences varies due to fluctuations in dimension error of components, the shift of their installation positions, or other factors, with the result that sheets are not aligned or are stuck for some unknown reason in many cases.

SUMMARY OF THE INVENTION

It is an object of the present invention to at least partially solve the problems in the conventional technology.

According to an aspect of the present invention, there is provided a sheet alignment mechanism including a stacking tray on which a sheet or sheet bundle transported along a sheet transport path is stacked; a pair of side fences that are movable in a sheet width direction and align edges of the sheet or sheet bundle, stacked on the stacking tray, in the sheet width direction; a single drive source that moves the side fences; and a detecting unit that detects home positions of the respective side fences.

According to still an aspect of the present invention, there is provided a sheet post-processing apparatus that includes the above sheet alignment mechanism.

According to still another aspect of the present invention, there is provided an image forming apparatus that includes the above sheet alignment mechanism.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below.

Figure 1:
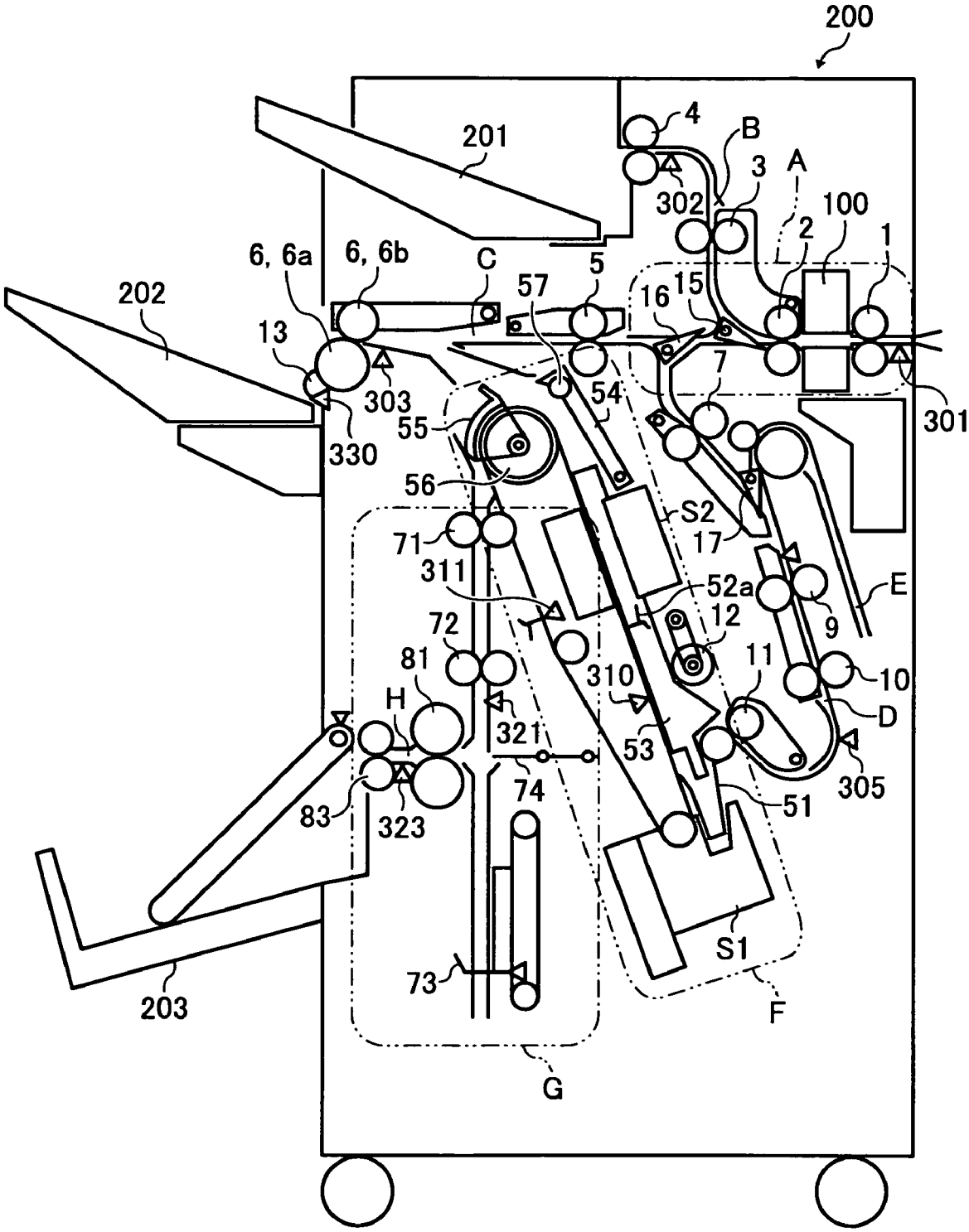
FIG. 1 is a schematic front view of a sheet post-processing apparatus according to an embodiment of the present invention.

FIG. 1 is a schematic front view illustrating a sheet post-processing apparatus that includes a sheet stapling mechanism and to which an embodiment of the present invention can be applied. The sheet post-processing apparatus shown in the present embodiment enables saddle stitch binding and is connected to an image forming apparatus (not shown) provided on the right side of the sheet post-processing apparatus. The present invention is not limited to this and, for example, the image forming apparatus may have a sheet stapling and alignment mechanism. Further, the present invention may be applied to image forming apparatuses of any type that discharge a sheet on which an image is formed, such as electrophotographic copiers, printers, facsimile machines, plotters, printing machines, and multifunction products.

In FIG. 1, a sheet post-processing apparatus 200 is provided on the left side of an image forming apparatus (not shown) connected thereto, and receives a sheet discharged from the image forming apparatus (not shown). The sheet post-processing apparatus 200 includes a transport path A that has a punching unit 100 serving as a post processing unit to perform a post processing on a single sheet, a transport path B that guides a sheet to an upper tray 201 via the transport path A, a transport path C that guides the sheet to a shift tray 202, a transport path D that guides the sheet to a processing tray F that performs alignment and stapling processes for the sheet and the like. Sheets to be transported are sorted to the transport paths with sort nails 15 and 16.

The sheets subjected to the alignment and stapling processes in the processing tray F are sorted to either the transport path C that guides the sheet to the shift tray 202 using a sort guide plate 54 and a movable guide 55, or a processing tray G that performs a folding process and the like. A sheet subjected to the folding process and the like in the processing tray G is discharged to a lower tray 203 via a transport path H. The transport path D includes a sort nail 17 held by a light load spring (not shown) as shown in FIG. 1. After a tailing end of the sheet passes the sort nail 17, at least transport rollers 9 among the transport rollers 9 and 10 and staple discharged sheet rollers 11 provided in the transport path D are reversely rotated so that the tailing end of the sheet is guided to and stored in a paper stacking unit E, allowing the sheet to be transported with the next sheet stacked thereon. Repeating this operation enables transportation of equal to or more than two sheets stacked on top of another.

The transport path A located in the upstream of the transport paths B, C, and D includes a gate sensor 301, a gate roller 1, the punching unit 100, transport rollers 2, and the sort nails 15 and 16, all of which are disposed in this order from the upstream in a sheet transport direction. The gate sensor 301 detects a sheet sent from an image forming apparatus (not shown), and the sort nails 15 and 16 are individually moved by solenoids (not shown). The sort nails 15 and 16 are held at the positions shown in FIG. 1 by springs (not shown), and turning on the solenoids (not shown) rotationally moves the sort nail 15 and 16 upward and downward, respectively. When the sheet is guided to the transport path B, the solenoids are turned off so that the sort nail 15 is positioned as shown in FIG. 1. When the sheet is guided to the transport path C, the solenoids are turned on so that the sort nails 15 and 16 are rotationally moved upward and downward, respectively. Further, when the sheet is guided to the transport path D, one of the solenoids is turned off to position the sort nail 16 as shown in FIG. 1, while the other solenoid is turned on to rotationally move the sort nail 15 upward.

In the downstream of the transport path C in the sheet transport direction are disposed shift discharged sheet rollers 6, a reverse skid 13, a sheet surface detection sensor 330, and the shift tray 202.

Figure 3:
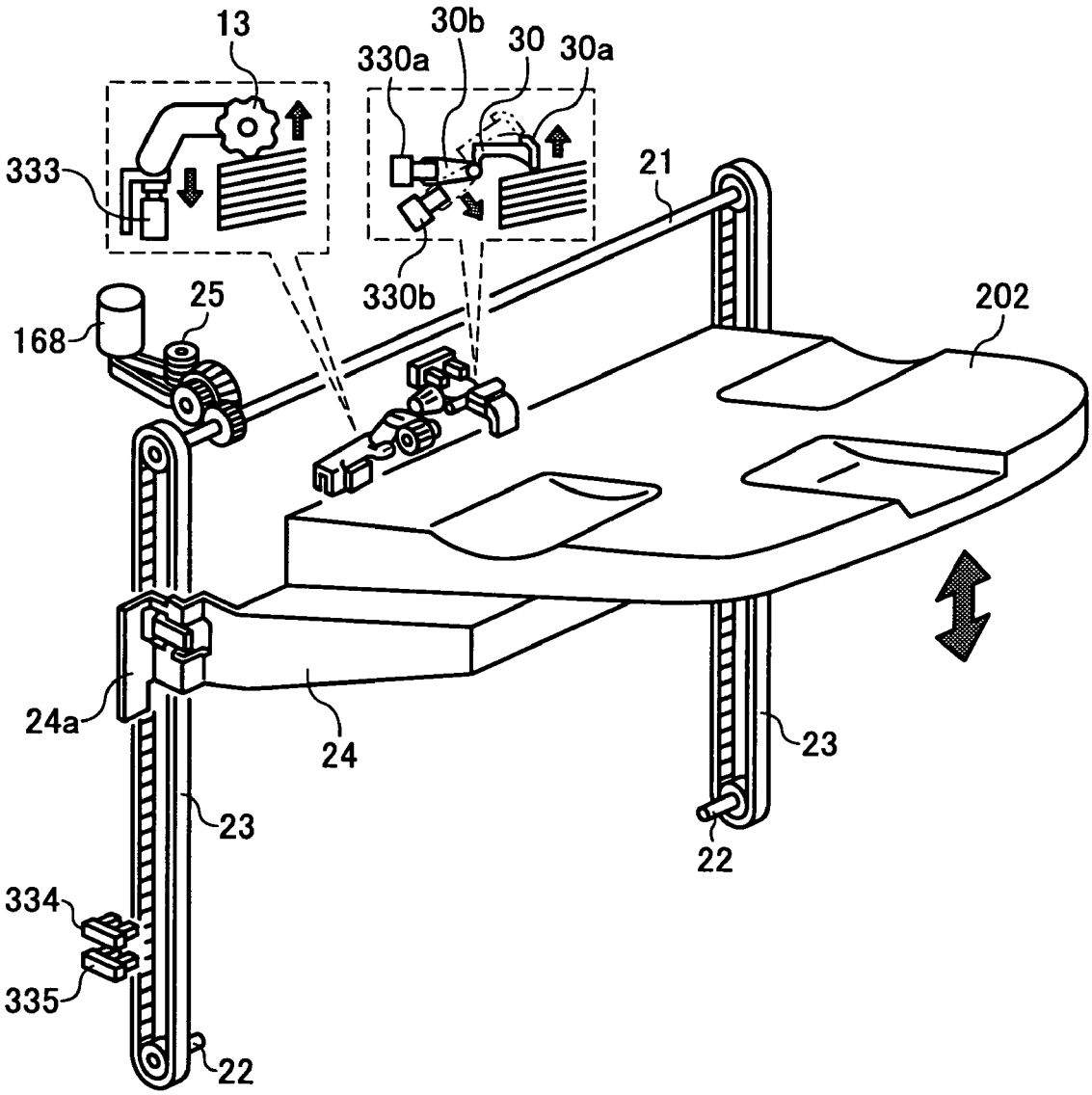
FIG. 3 is a schematic perspective view of an up-and-down mechanism of the shift tray.

As shown in FIG. 3, the shift tray 202 moves up and down as a drive shaft 21 is driven. Between the drive shaft 21 and a follower shaft 22 provided with a predetermined distance from the drive shaft 21, timing belts 23 are hung with a predetermined tension via timing pulleys. On the timing belts 23, a side plate 24 is fixed to support the shift tray 202. Further, a drive force from a tray up-and-down motor 168, capable of forward reverse rotation to move the shift tray 202 up and down, is transferred via a warm 25 to a final gear of gear arrays fixed on the drive shaft 21. This structure allows the shift tray 202 to be held at a predetermined position because the force is transferred via the warm 25, enabling to prevent the shift tray 202 from accidentally falling.

On the side plate 24, shielding plates 24*a* are integrally provided. Further, at the lower part of an up-and-down path of the shift tray 202 are provided a full detection sensor 334 and a lower limit sensor 335. The full detection sensor 334 detects that sheets stacked on the shift tray 202 are full, and the lower limit sensor 335 detects a lower limit position of the shift tray 202. The sensors 334 and 335 detect the shielding plates 24*a* when the shift tray 202 moves down and issue a signal, so that position of the shift tray 202 is detected. In FIG. 3, the shift discharged sheet rollers 6 are omitted.

Figure 2:
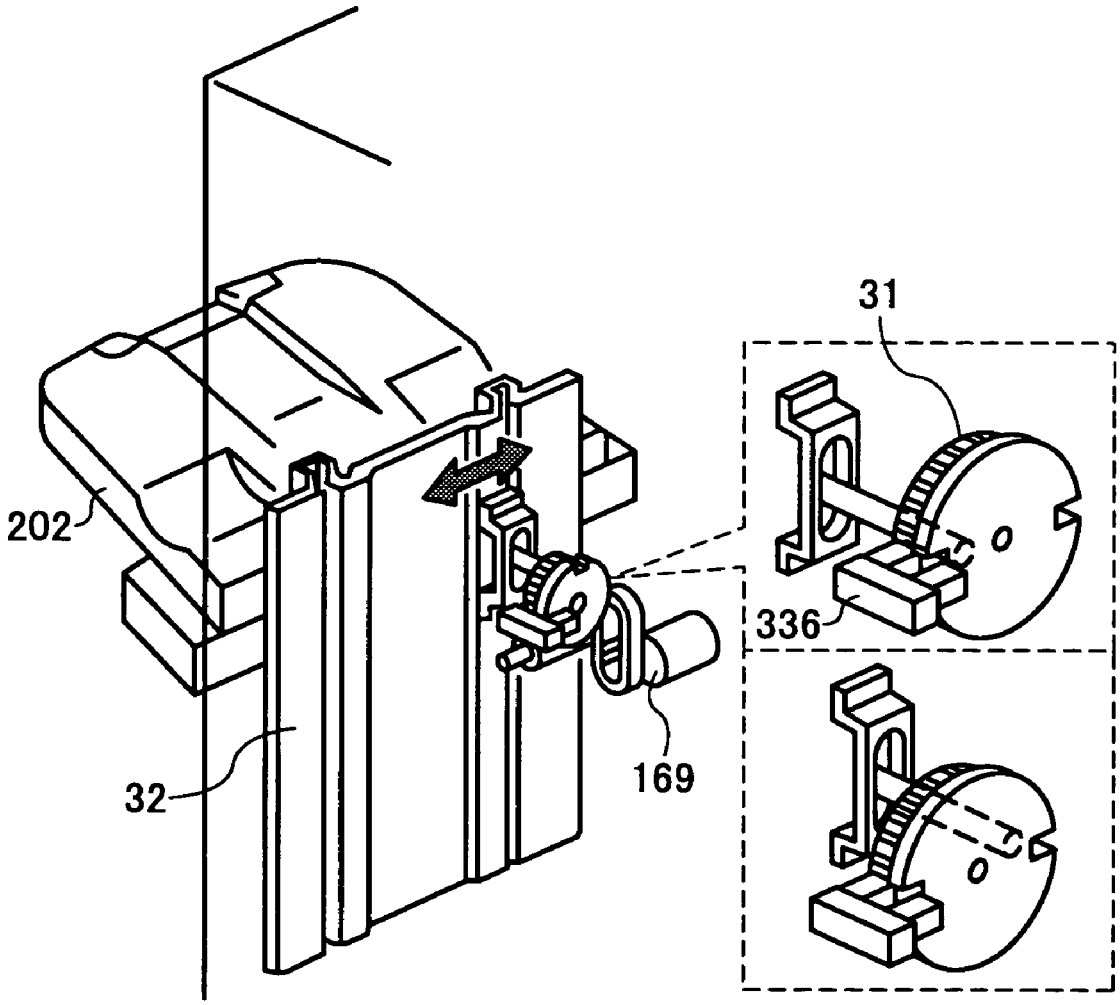
FIG. 2 is a schematic perspective view of a fluctuation mechanism of a shift tray shown in FIG. 1.

As shown in FIG. 2, the shift tray 202 can have fluctuating movement a shift cam 31 is rotated by a shift motor 169. The shift cam 31 has pins provided on its circumference, and each pin catches a long hole extended in the tray up-and-down direction on an end fence 32 that guides the tailing end of each sheet stacked on the shift tray 202. With this structure, when the shift cam 31 rotates, the end fence 32 catching each pin moves in a sheet width direction, causing the shift tray 202 connected to the end fence 32 to move in the sheet width direction. The shift tray 202 is positioned selectively at either the front or back side of the apparatus, and each position is determined according to detection made by the shift sensor 336 for two cutouts, formed opposite to each other on the circumference of the shift cam 31.

Figure 4:
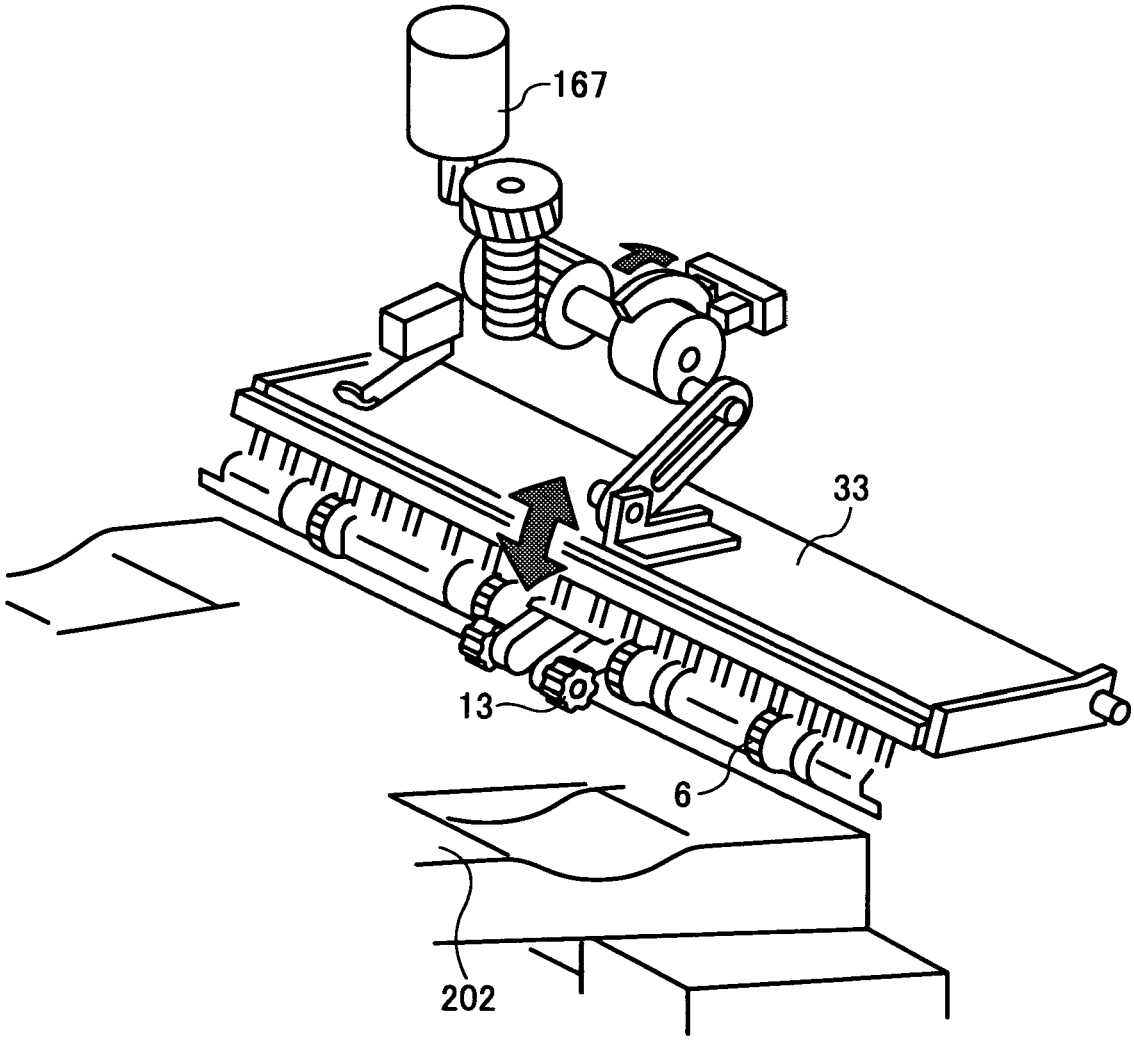
FIG. 4 is a schematic perspective view of an opening and closing mechanism of an opening and closing guide plate and how a shift discharged sheet roller is held.

The shift discharged sheet rollers 6 include a drive roller 6*a* rotationally driven by a driving unit (not shown), and a follower roller 6*b* provided to pressure and contact the drive roller 6*a*. As shown in FIG. 4, the follower roller 6*b* is rotatably supported on a free edge of an opening and closing guide plate 33 that moves freely and rotationally in the up-and-down direction with its one side in the upstream of the sheet transport direction supported. The follower roller 6*a* is provided to pressure and contact the drive roller 6*a* by its own weight or a biasing force of a biasing unit (not shown) so that a sheet is caught between the rollers and discharged. When discharging a sheet bundle subjected to a stapling process described later, the opening and closing guide plate 33 rotationally moves upward and recovers at a predetermined timing according to a detection signal from a shift discharged sheet sensor 303. The opening and closing guide plate 33 is stopped at a position determined based on the detection signal from a discharged sheet guide plate opening and closing sensor 331, and the opening and closing guide plate 33 is rotationally moved by a drive force from a discharged sheet guide plate opening and closing motor 167.

The reverse skid 13, made of a sponge like material, comes in contact with a sheet discharged from the shift discharged sheet rollers, causing the tailing end of the sheet to hit an end fence (not shown) to align the sheet. The reverse skid 13, supported to have a free fluctuating movement, pressures and contacts the shift discharged sheet rollers 6 so as to rotate in response to rotation of the shift discharged sheet rollers 6. As shown in FIG. 3, a tray elevation limit switch 333 is provided near the reverse skid 13. Elevation of the shift tray 202 lifts the reverse skid 13 and turns on the tray elevation limit switch 333, causing the tray elevation motor 168 to stop moving. This prevents the shift tray 202 from overrunning.

Near the reverse skid 13 is provided a sheet surface detection sensor 330 that detects the position of an upper surface of sheets stacked on the shift tray 202 as shown in FIG. 1. The sheet surface detection sensor 330 includes a sheet surface detection lever 30, a sheet surface detection sensor (for stapling) 330*a*, and a sheet surface detection sensor (for non-stapling) 330*b* as shown in FIG. 3. The sheet surface detection lever 30 is pivotably supported about a shaft section provided in the middle thereof. The sheet surface detection lever 30 has on its one end a contact section 30*a* coming in contact with a top surface of sheets staked on the shift tray 202, while having a shielding section 30*b* on the other end. The sheet surface detection sensor 330*a* is mainly used to control stapled discharged sheets and the sheet surface detection sensor 330*b*, provided below the sheet surface detection sensor 330*a*, is mainly used to control shifted discharged sheets. In the present embodiment, when the shielding section 30*b* is detected, the sensors 330*a* and 330*b* turn on. Further, when the shift tray 202 moves up and the contact section 30*a* pivotally moves up, the sheet surface detection sensor 330*a* turns off. When the contact section 30*a* pivotally moves further up, the sheet detection sensor 330*b* turns off. This enables the sensors 330*a* and 330*b* to detect that the sheets stacked on the shift tray 202 have reached a predetermined height. Further, according to the detection signal, the shift tray 202 can be moved down by a predetermined amount, allowing the surface of the sheets on the shift tray 202 to retain in an almost constant position.

The following describes a structure of a processing tray F that performs the stapling process.

Figure 6:
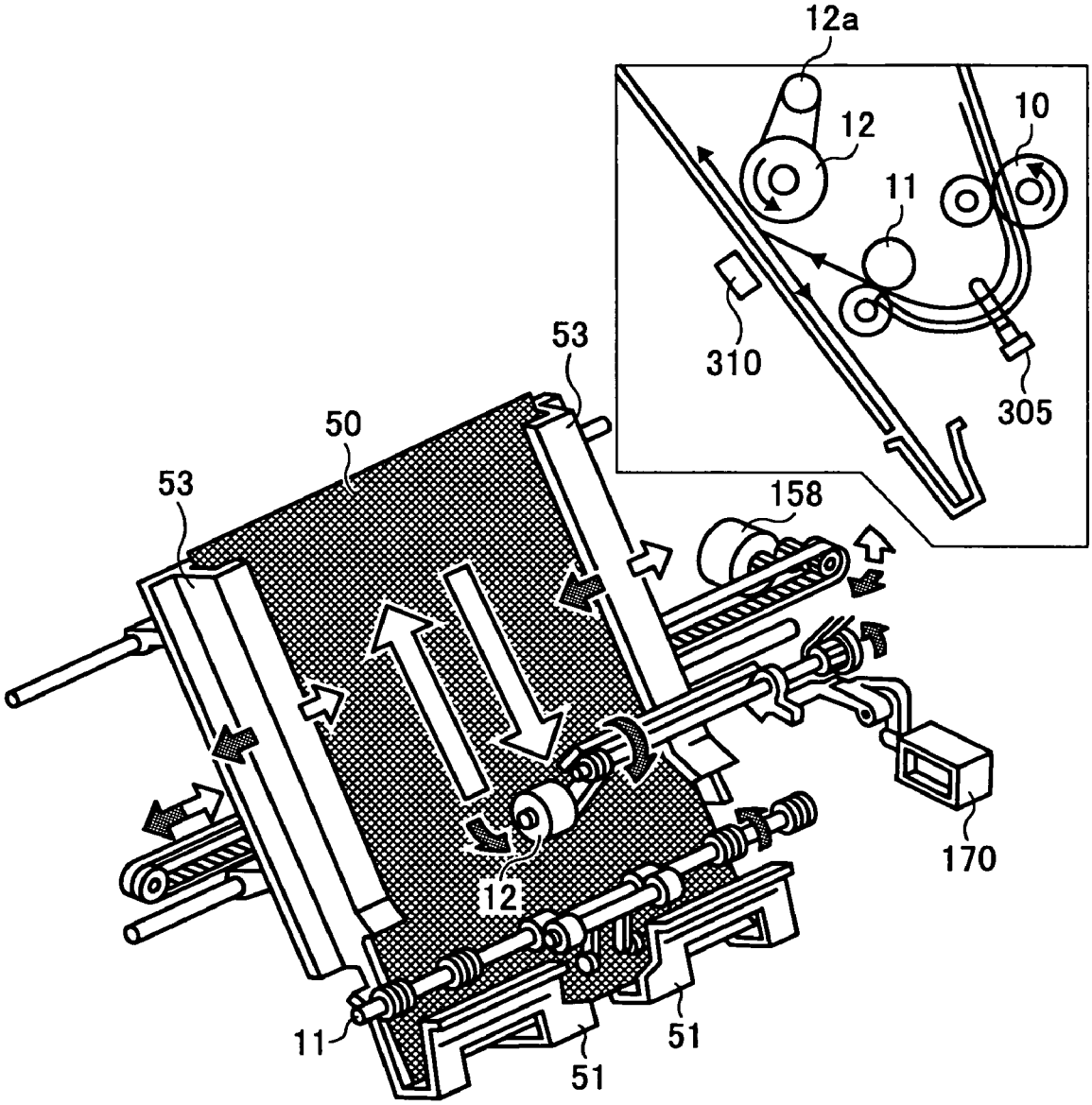
FIG. 6 is a schematic perspective view of a movement mechanism of jogger fences.

As shown in FIG. 6, sheets guided to the processing tray F by the staple discharged sheet rollers 11 are sequentially stacked on the stacking tray 50. Each of the stacked sheets is aligned in a sheet transport direction with a drum skid 12 and in a sheet width direction with a pair of side fences, i.e., jogger fences 53. In a break between jobs, i.e., a break between the last sheet of a sheet bundle and the first sheet of the next sheet bundle, an end face stapler S1 placed on an lower end of the stacking tray 50 is driven according to a staple signal from a controlling unit 350 described later, and the stapling process for a sheet bundle is performed. The sheet bundle subjected to the stapling process is sent by a discharge belt 52 having two discharge nails 52*a* as shown in FIG. 1 to the shift discharged sheet rollers 6 immediately after the stapling process, so as to be discharged onto the shift tray 202 residing in its receiving position.

Figure 5:
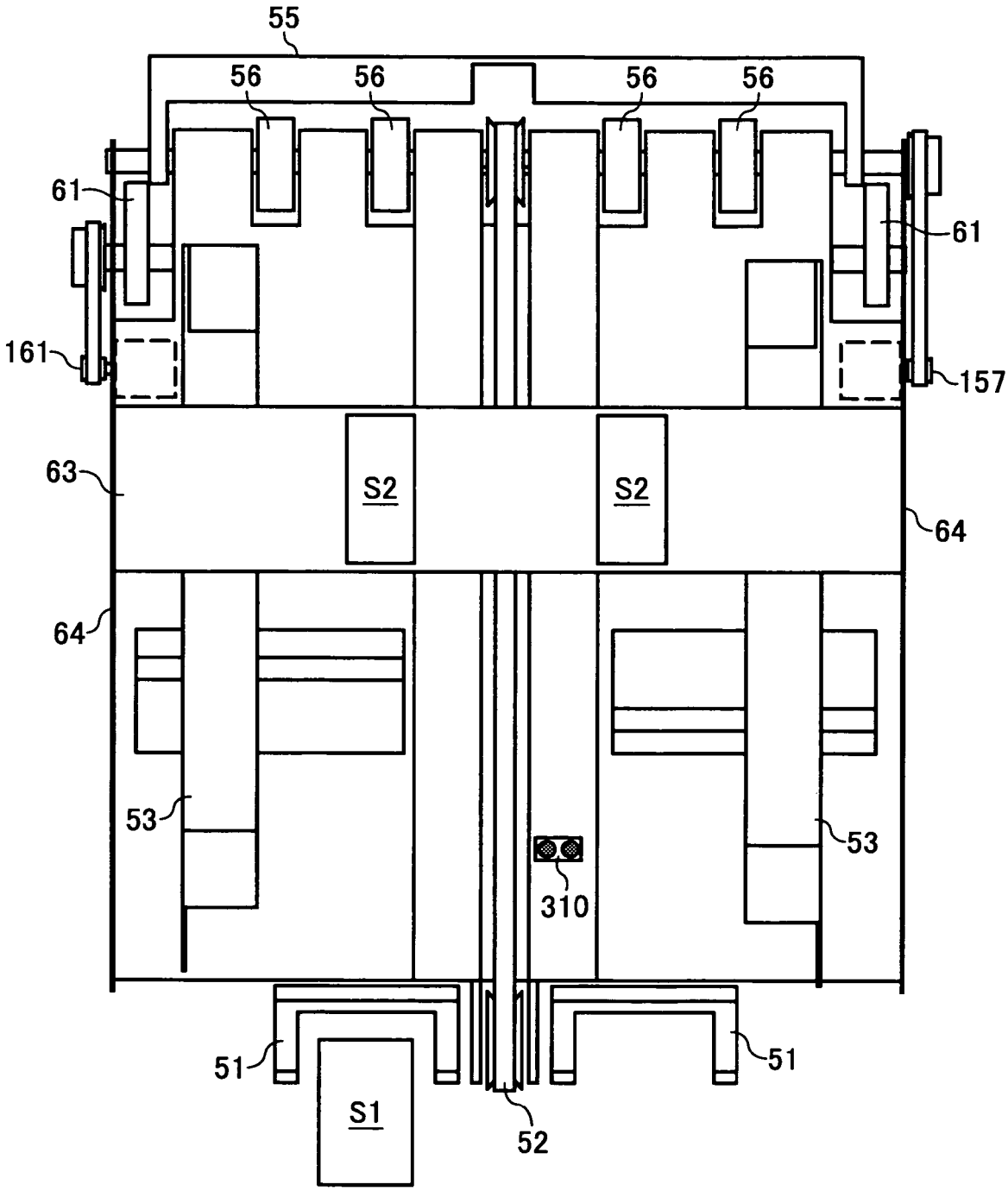
FIG. 5 is a schematic front view of a post processing mechanism shown in FIG. 1.
Figure 7:
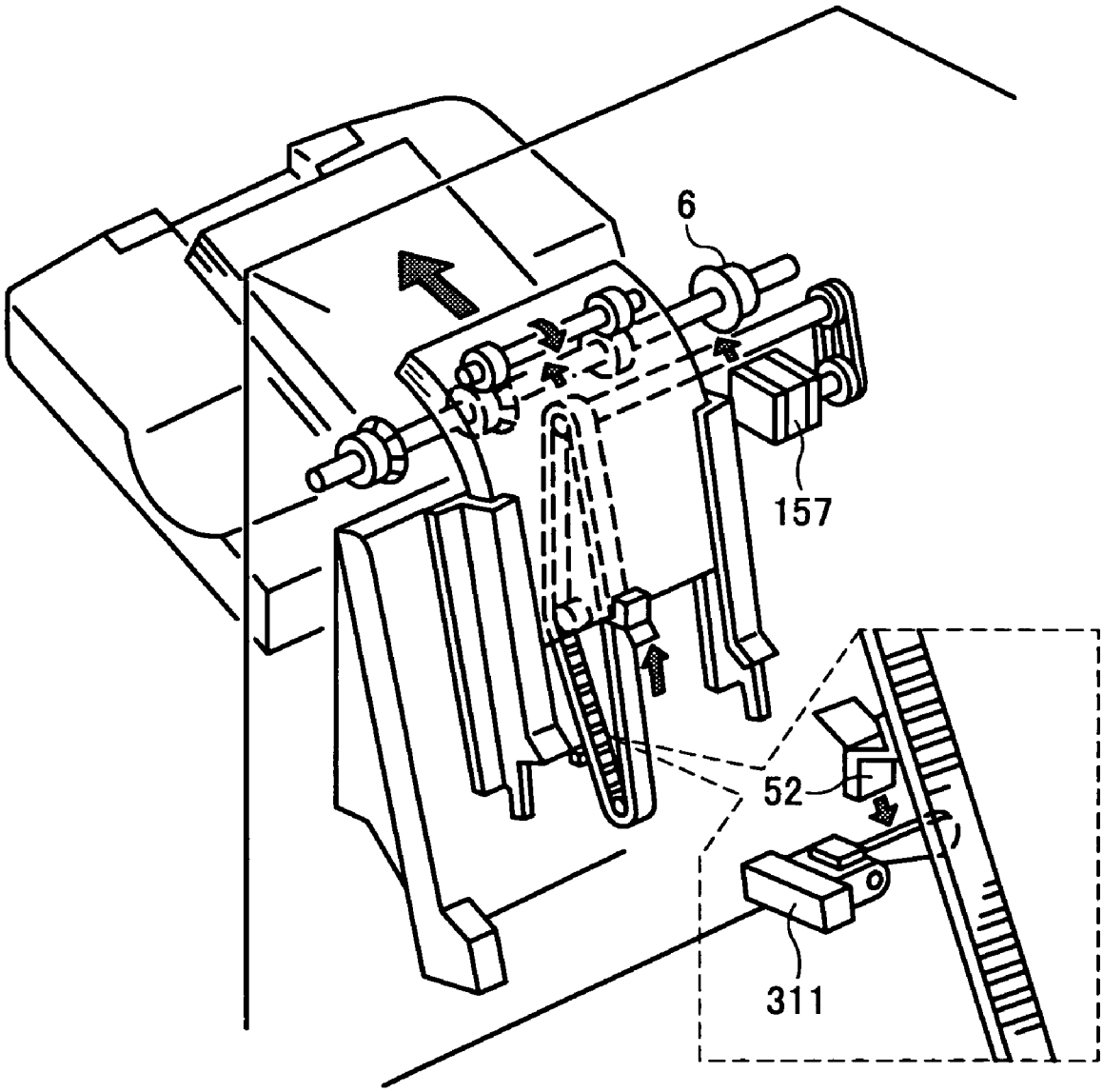
FIG. 7 is a schematic perspective view of a movement mechanism of discharge nails shown in FIG. 1.

As shown in FIG. 5, on a drive shaft of the discharge belt 52 moved by a drive force of the discharge motor 157, the discharge belt 52 and a drive pulley are disposed at the center in a direction along the shaft. With respect to this, a plurality of discharge rollers 56 are disposed symmetrically. The rotational speed of the discharge rollers 56 is set faster than the movement speed of the discharge belt 52. The two discharge nails 52*a* are disposed opposite to each other on the outer circumference of the discharge belt 52, and move to alternatively discharge a sheet bundle stacked on the stacking tray 50. Further, the positions of each discharge nail 52*a* on the discharge belt 52 are detected by a discharge belt home position sensor 311 shown in FIG. 7. The discharge belt 52 may be moved in the reverse direction as necessary to make the rear face of the discharge nail 52*a* comes in contact with an end of a sheet bundle stacked on the stacking tray 50, thereby aligning the sheet bundle stacked on the stacking tray 50 in the sheet transport direction.

Figure 8:
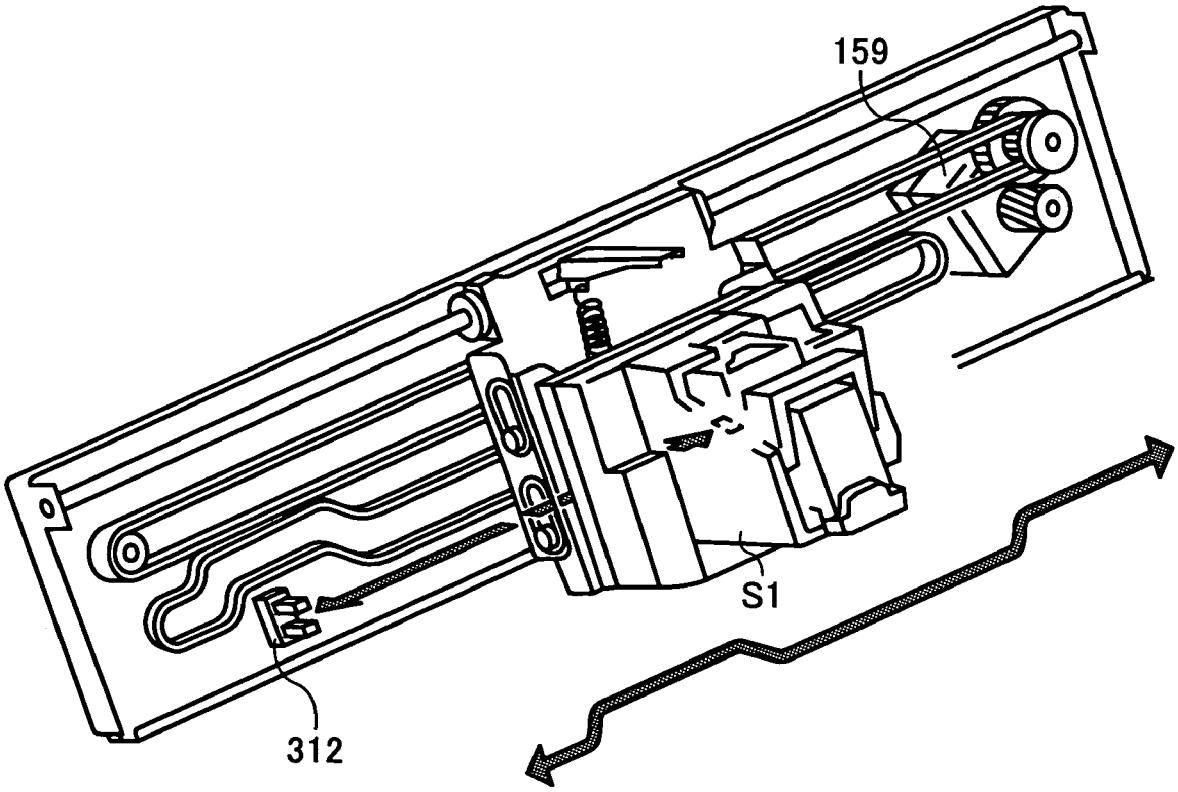
FIG. 8 is a schematic perspective view of a movement mechanism of an end fence stapler shown in FIG. 1.
Figure 9:
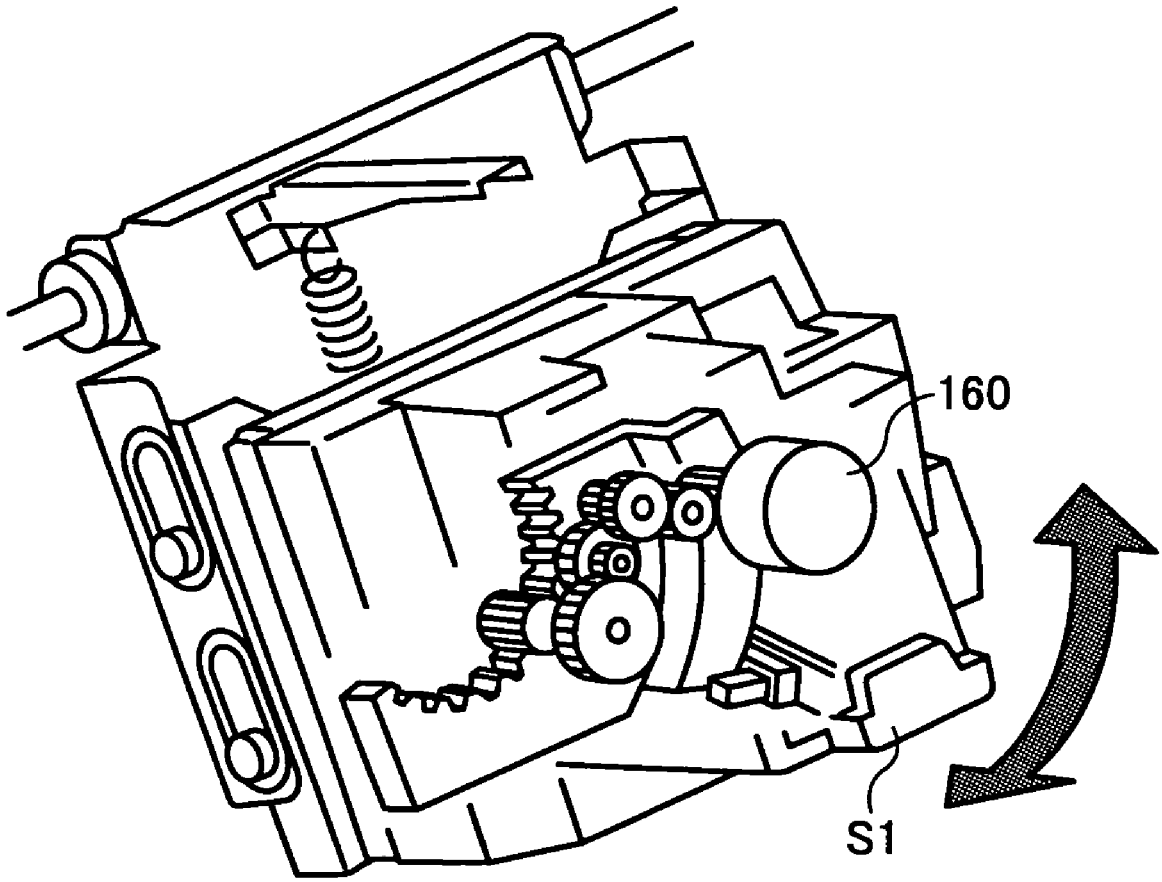
FIG. 9 is a schematic perspective view of a skew motor.

As shown in FIG. 6, the drum skid 12 is pivotably supported about a supporting point 12*a*. The drum skid 12 pivots according to operation of a solenoid 170, and intermittently interacts with a sheet sent to the stacking tray 50 to hit a rear end fence 51 serving as a standard fence. The drum skid 12 is rationally driven by a driving unit (not shown) in a direction indicated by an arrow of FIG. 6. The jogger fences 53 move back and forth in the sheet width direction when a drive force of a jogger motor 158, capable of forward and reverse movement and serving as a single drive source, is transferred via a timing belt. As shown in FIG. 8, the end fence stapler S1 is moved by a stapler moving motor 159 capable of forward and reverse movement via the timing belt in the sheet width direction so that sheets are stapled at a predetermined point of the end of the sheets. At one end of the moving range of the end face stapler S1 is provided a stapler movement home position sensor 312 that detests a home position of the end face stapler S1. This enables control of a stapling point in the sheet width direction according to a travel amount of the end fence stapler S1 from this home position. Further, two saddle stitch binding staplers S2 are disposed symmetrically with respect to the center point for alignment in the sheet width direction, so that a distance from the rear end fences 51 to the stapling point becomes equal to or larger than half the length, in a transport direction, of a maximum sheet size allowed for saddled stitch binding as shown in FIGS. 1 to 5. Further, the two staplers are fixed on a stay 63.

The following describes structures of the sort guide plate 54 and the movable guide 55.

Figure 10A:
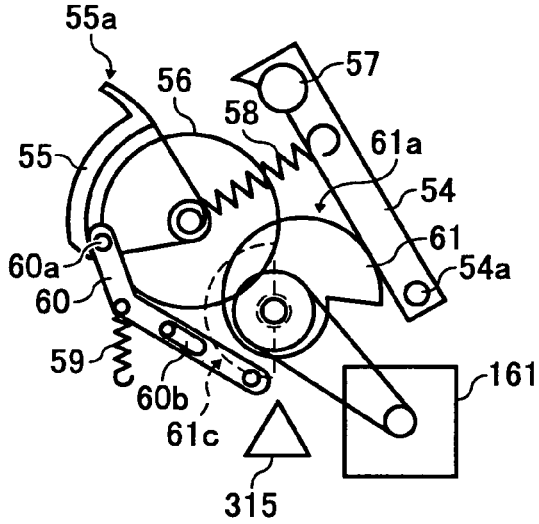
FIGS. 10A, 10B, and 10C are schematic views that explain states of a sort guide plate and a movable guide that are used in the embodiment of the present invention.

As shown in FIG. 10A, the sort guide plate 54 is pivotably supported in an up-and-down direction about a supporting point 54*a*. In the downstream end of the sort guide plate 54 in the sheet transport direction, a pressure skid 57 is provided. To the sort guide plate 54, one end of a spring 58 is attached and a biasing force is applied in a direction to pressure and contact the circumference surfaces of the discharge rollers 56. Near the sort guide plate 54 is provided a cam 61 that is rotationally driven by a bundle sort drive motor 161. The sort guide plate 54 is pressured to come in contact with a cam surface 61*a* of the cam 61 by the biasing force of the spring 58. The position of the sort guide plate 54 is changed according to the rotation of the cam 61.

The movable guide 55 is pivotably supported about a pivot shaft of the discharge roller 56, and connected to a link arm 60 capable of pivotal movement. The link arm 60 has a long hole section 60*b* engaged with a shaft fixed on a side plate 64. This limits a pivoting range of the movable guide 55. Further, the link arm 60 is biased downwardly by a spring 59, so that the movable guide 55 is held in the position shown in FIG. 10A. When the cam 61 rotates according to operation of the bundle sort drive motor 161, the cam surface 61*a* pushes the link arm 60 and thus the movable guide 55 pivots upwardly. Below the cam 61, a bundle sort guide home position sensor 315 is provided. The bundle sort home position sensor 315 detects a shielding section 61*c* of the cam 61, so that a home position of the cam 61 is detected. According to a drive pulse from the bundle sort drive motor 161 based on this home position, a stop position of the cam 61 is controlled.

Figure 10B:
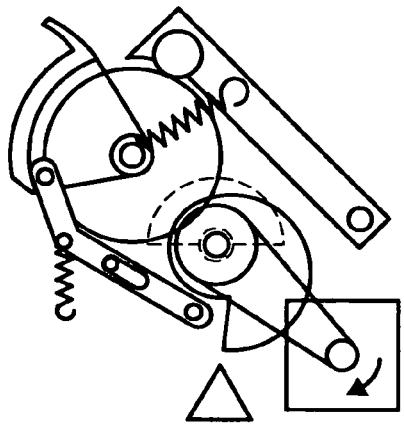
Figure 10C:
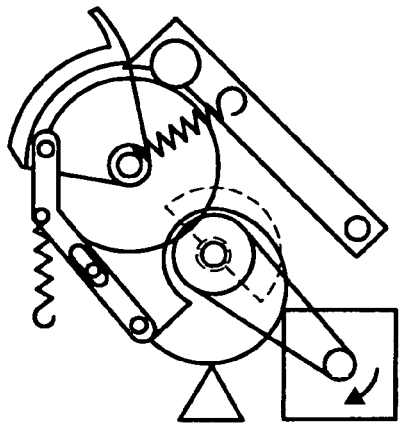

FIG. 10A is a schematic view of a positional relationship of the sort guide plate 54 and the movable guide 55 when the cam 61 is in its home position. The movable guide 55 has a guide surface 55*a* that serves to guide a sheet to the shift discharged sheet rollers 6. FIG. 10B is a schematic view of the state that rotation of the cam 61 pivotally moves the sort guide plate 54 downwardly and the pressure skid 57 pressures and contacts the discharge roller 56. FIG. 10C is a schematic view of the state that the cam 61 further rotates and the movable guide 55 pivots upwardly, enabling the sort guide plate 54 and the movable guide 55 to form a path to guide a sheet from the processing tray F to the processing tray G. Further, FIG. 5 is a schematic view of a positional relationship in a depth direction. In the present embodiment, although the sort guide plate 54 and the movable guide 55 are driven by a single drive motor, drive motors may be respectively provided for the sort guide plate 54 and the movable guide 55 so that movement timings and stop positions for them can be individually controlled according to the size or number of sheets to be stapled together, etc.

Figure 11A:
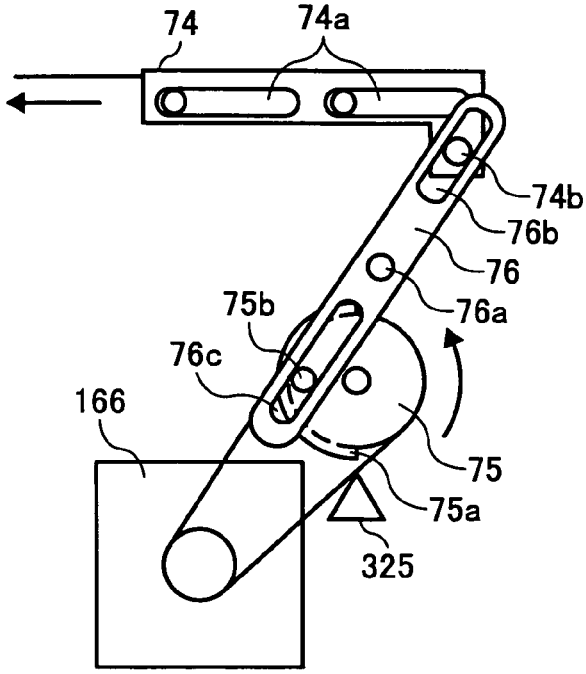
FIGS. 11A and 11B are schematic views that explain a folding plate used in the embodiment of the present invention.
Figure 11B:
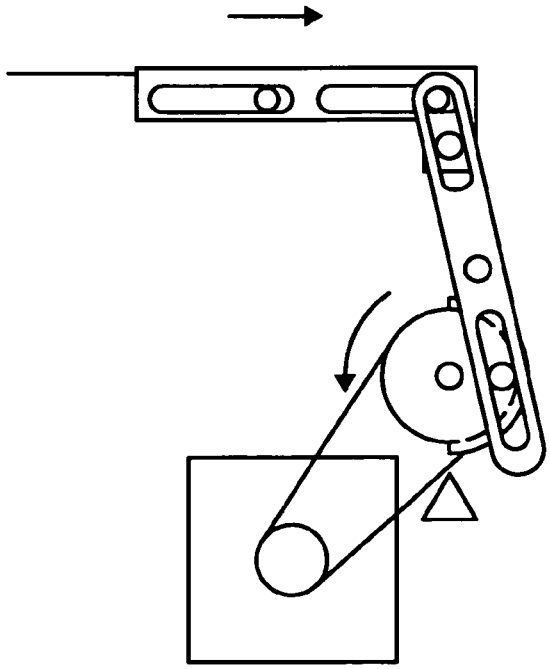

With reference to FIGS. 11A and 11B, the following describes a movement mechanism of a folding plate 74.

The folding plate 74 is supported such that its long holes 74*a* catch two shafts that are provided on the front and back portions of a side plate. The folding plate 74 has a shaft section 74*b* that catches a long hole 76, provided on a link arm 76 capable of pivoting about a supporting point 76*a*. This enables the folding plate 74 to move back and forth in a lateral direction in FIGS. 11A and 11B. The link arm 76 has a long hole 76*c* that catches a shaft section 75*b* of a folding plate drive cam 75, and pivots according to rotation of the folding plate drive cam 75. The folding plate drive cam 75 is rotationally driven by a folding plate drive motor 166 in a direction indicated by an arrow of FIGS. 11A and 11B, and its stop position is determined according to the result of detection made by the holding plate home position sensor 325 for both edges of a shielding section 75*a* having a halfmoon shape. FIG. 11A is a schematic view of a home position of the folding plate 74, which is completely drawn from a sheet bundle receiving region of the processing tray G. When the folding plate drive cam 75 is rotated in a direction indicated by an arrow of FIG. 11A, the folding plate 74 moves in a direction indicated by an arrow of FIG. 11A and sticks into the sheet bundle receiving region of the processing tray G. FIG. 11B is a schematic view of a position at which the center of the sheet bundle is pushed into a nip between folding rollers 81 of the processing tray G. When the folding plate drive cam 75 is rotated in a direction indicated by the arrow of FIG. 11B, the folding plate 74 moves in the direction indicated by an arrow of FIG. 11B, and is withdrawn from the sheet bundle receiving region of the processing tray G.

Figure 13:
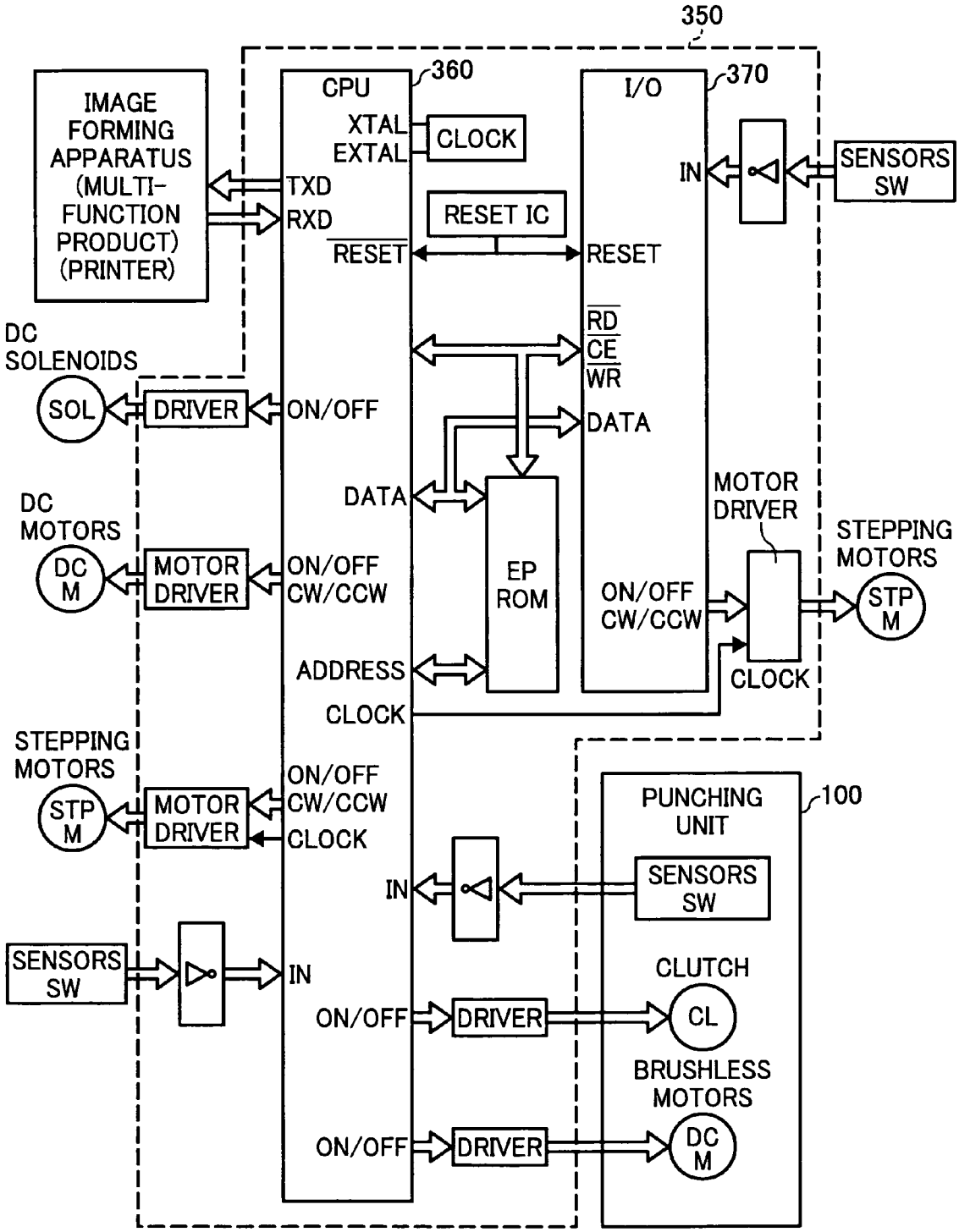
FIG. 13 is a block diagram of a controlling unit used in the embodiment of the present invention.

FIG. 13 is a block diagram of a controlling unit used in the present embodiment. The controlling unit 350 is a microcomputer that includes a CPU 360, an I/O interface 370, and the like. The CPU 360 receives via the I/O interface 370 a signal entered from each switch on a control panel provided in an image forming apparatus (not shown) and a signal from each sensor such as the sheet surface detection sensor 330. According to the received signal, the CPU 360 controls operations of the tray up-and-down motor 168 used for the shift tray 202, the discharged sheet guide plate opening and closing motor 167 that opens and closes the opening and closing guide plate 33, the shift motor 169 that moves the shift tray 202, a drum skid motor 156 that drives the drum skid 12, solenoids such as the solenoid 170 etc., a transport motor that drives each transport roller, a discharged sheet motor that drives each discharged sheet roller, the discharge motor 157 that drives the discharge belt 52, the stapler moving motor 159 that moves the end face stapler S1, a skew motor 160 that obliquely rotates the end face stapler S1, the jogger motor 158 that moves the jogger fences 53, the bundle sort drive motor 161 that pivots the sort guide plate 54 and the movable guide 55, a bundle transport motor 162 that drives a transport roller to transport a sheet bundle, the rear end fence moving motor 163 that moves a movable rear end fence 73, the folding plate drive motor 166 that moves the folding plate 74, a roller drive motor 164 that drives the folding rollers 81, and the like. A pulse signal from a staple transport motor (not shown) that drives the staple discharged sheet rollers 11 is fed to the CPU 360 and counted, so that operations of the solenoid 170 and the jogger motor 158 are controlled according to the count.

The sheet post-processing apparatus 200 according to the present embodiment has five types of post processing modes: a non-staple mode A, a non-staple mode B, a sort and stack mode, a staple mode, and a saddle stitch binding mode. In the non-staple mode A, a sheet is transported along the transport paths A and B and discharged to the upper tray 201. In the non-staple mode B, the sheet is transported along the transport paths A and C and discharged to the shift tray 202. In the sort and stack mode, the sheet is transported along the transport paths A and C and discharged to the shift tray 202. In this case, the shift tray 202 is wobbled in a sheet width direction during each break between jobs, enabling to sort the sheet to be discharged. In the staple mode, the sheet is transported along the transport paths A and D and subjected to the alignment and stapling processes in the processing tray F, and then passed along the transport path C to be discharged to the shift tray 202. In the saddle stitch binding mode, the sheet is transported along the transport paths A and D and subjected to the alignment and stapling processes in the processing tray F, then subjected to a middle folding process in the processing tray G, passed along the transport path H, and discharged to the lower tray 203.

The following describes operations of the modes.

Figure 14:
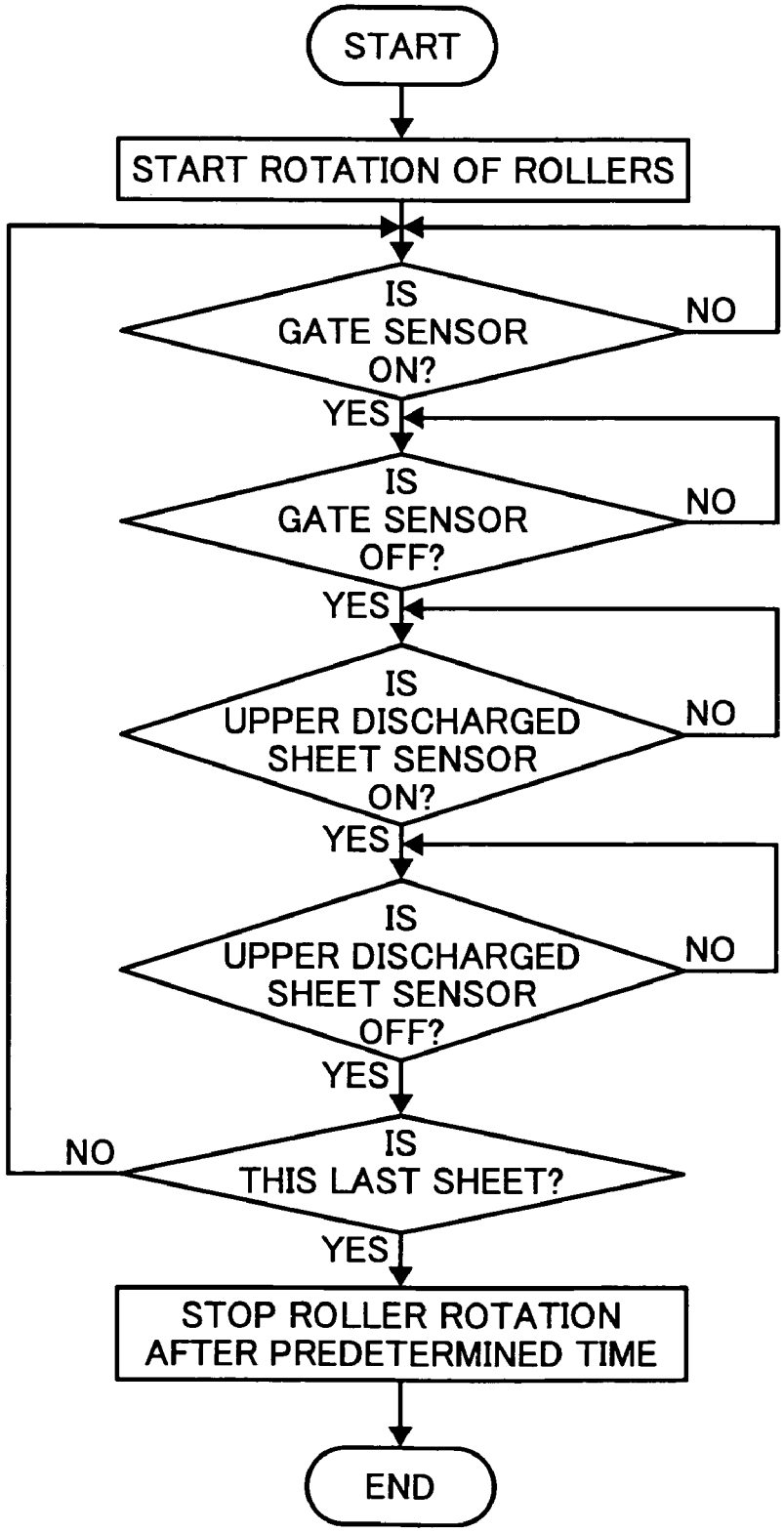
FIG. 14 is a flowchart of operations in a non-staple mode A according to the embodiment of the present invention.

In the non-staple mode A, a sheet from the transport path A is sorted with the sort nail 15, guided to the transport path B, and discharged to the upper tray 201 by transport rollers 3 and discharged sheet rollers 4. Near the discharged sheet rollers 4 is provided an upper discharged sheet roller sensor 302 that detects discharging of the sheet. The state of discharged sheet is monitored by the upper discharged sheet sensor 302. The flow of operation in the non-staple mode A is shown in FIG. 14.

Figure 15:
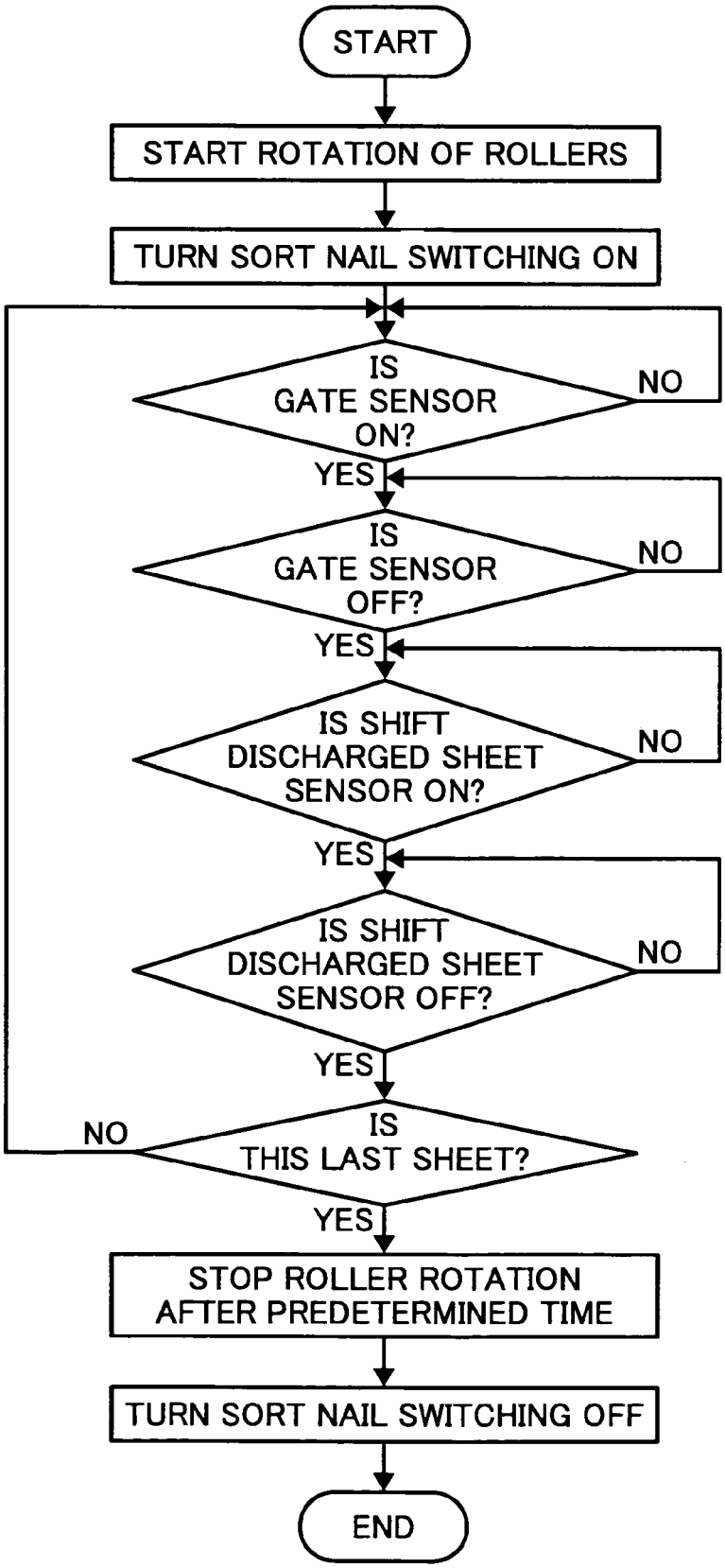
FIG. 15 is a flowchart of operations in a non-staple mode B according to the embodiment of the present invention.

In the non-staple mode B, a sheet from the transport path A is sorted with the sort nails 15 and 16, guided to the transport path C, and discharged to the shift tray 202 with the transport rollers 5 and the shift discharged sheet rollers 6. Near the shift discharged sheet rollers 6 is provided a shift discharged sheet sensor 303 that detects discharging of the sheet. The state of discharged sheet is monitored by the shift discharged sheet sensor 303. The flow of operation of the non-staple mode B is shown in FIG. 15.

Figure 16:
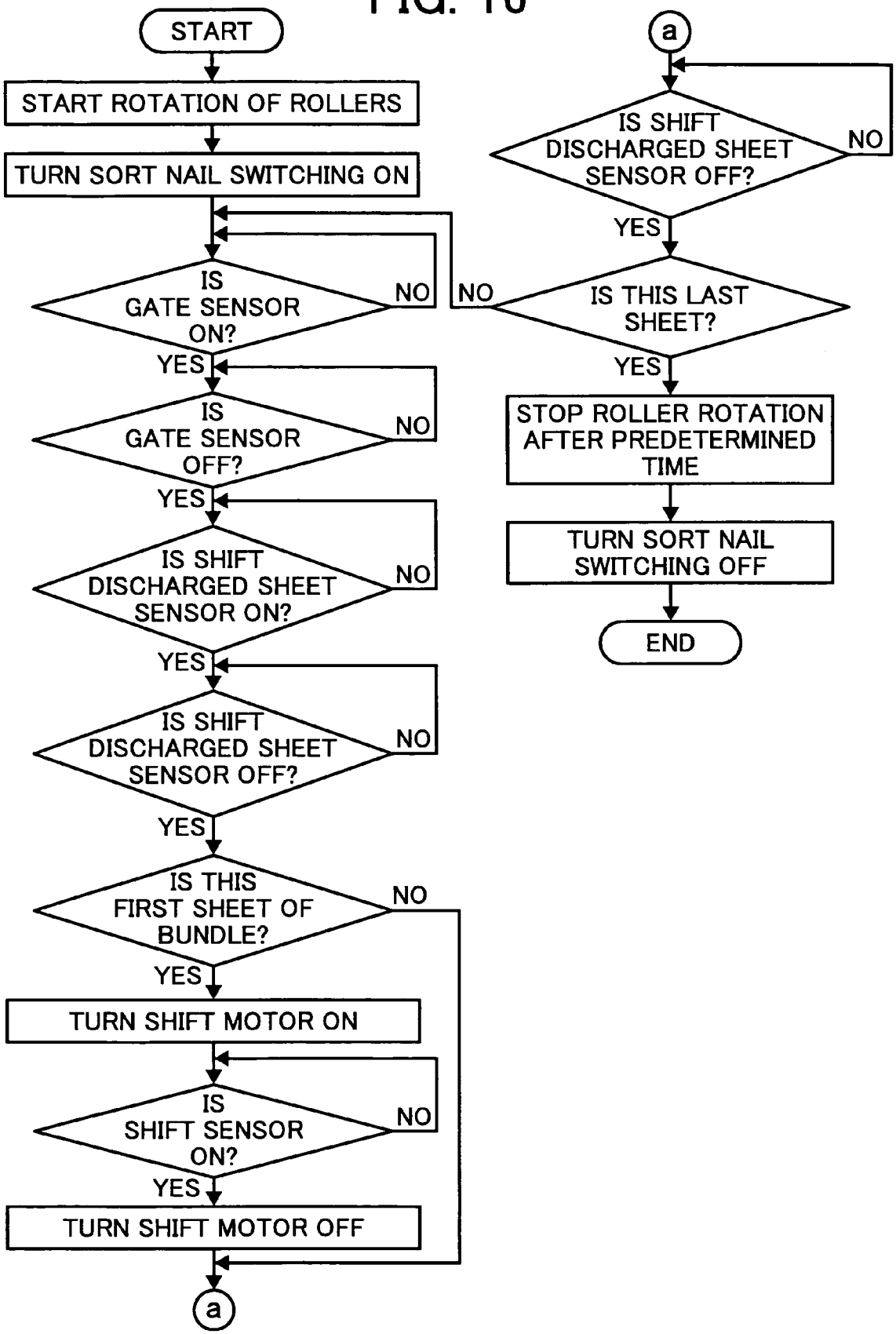
FIG. 16 is a flowchart of operations of a sort and stack mode according to the embodiment of the present invention.

In the sort and stack mode, a sheet is transported and discharged as in the non-staple mode B. To discharge a sheet to the shift tray 202, the shift tray 202 is wobbled in a sheet width direction during each break between jobs, so as to sort the sheet to be discharged. The flow of operation in the sort and stack mode is shown in FIG. 16.

Figure 17:
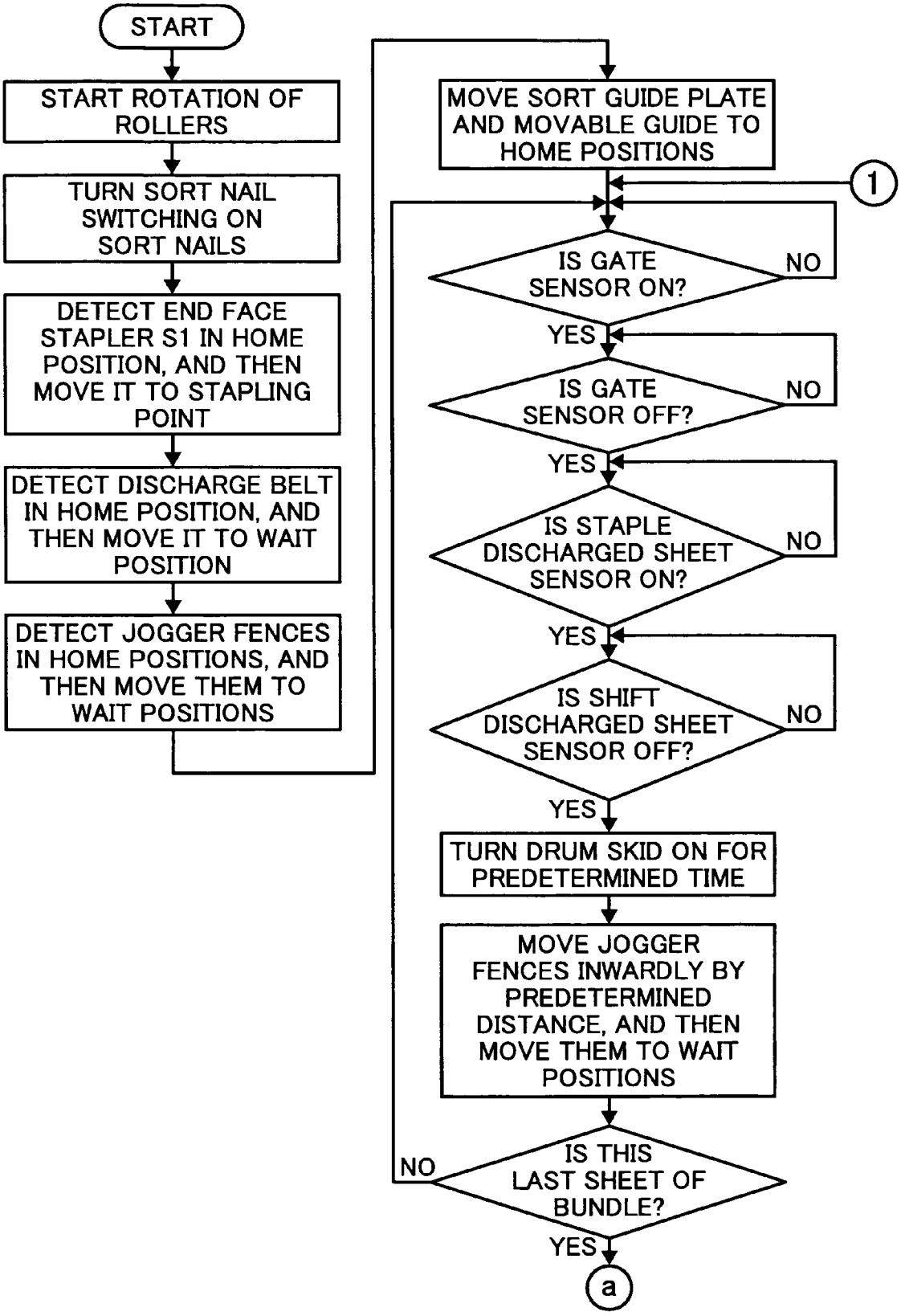
FIG. 17 is a flowchart of operations in a staple mode according to the embodiment of the present invention.
Figure 18:
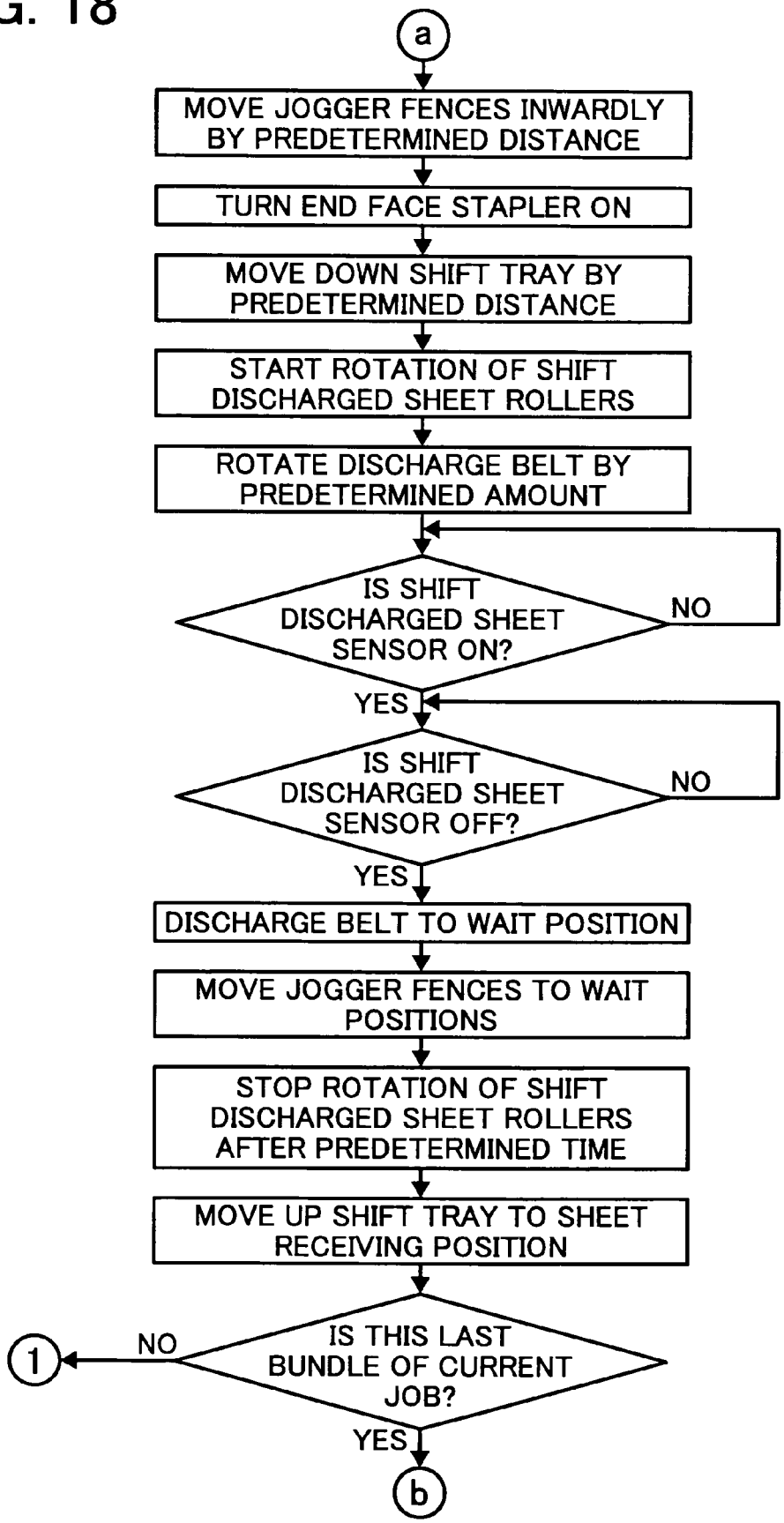
FIG. 18 is a flowchart of operations in the staple mode according to the embodiment of the present invention.
Figure 19:
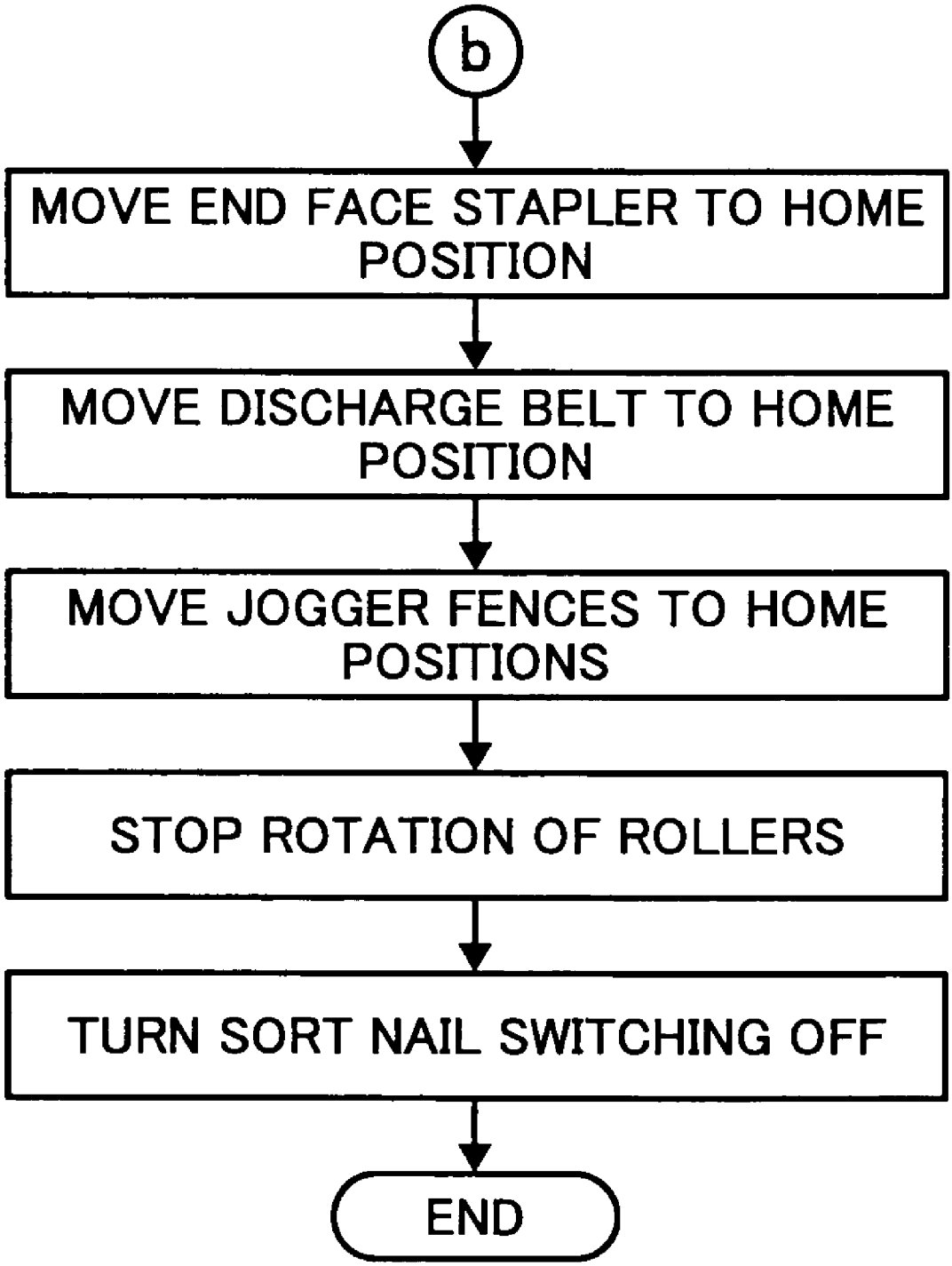
FIG. 19 is a flowchart of operations in the staple mode according to the embodiment of the present invention.

In the staple mode, a sheet from the transport path A is sorted with the sort nails 15 and 16, guided to the transport path D, and discharged to the processing tray F by the transport rollers 7, 9, and 10 and the staple discharged sheet rollers 11. In the processing tray F, sheets to be sequentially discharged by the staple discharged sheet rollers 11 are aligned, and then subjected to the stapling process according to operation of the edge face stapler S1 when a predetermined number of sheets are stacked. The sheet bundle thus stapled is then transported to the downstream by the discharge nails 52*a*, and discharged to the shift tray 202 by the shift discharged sheet rollers 6. The state of the discharged sheets is monitored by the shift discharged sheet sensor 303. The flow of operation in the staple mode is shown in FIGS. 17 to 19.

The operation of the processing tray F in the staple mode is described below.

When the staple mode is selected, as shown in FIG. 6, the jogger fences 53 move from their home positions, and stop at their wait positions, i.e., points 7 millimeters away from the edge of the sheet to be discharged to the stacking tray 50. When the sheet is transported by the staple discharged sheet rollers 11 and the tailing end of the sheet is passed through the staple discharged sheet sensor 305, the jogger fences 53 move inwardly by 5 millimeters from the wait positions and stop. Further, the staple discharged sheet sensor 305 detects it when the tailing end of the sheet is passed therethrough, so that a detection signal is fed to the CPU 360. From a time point of receiving the signal, the CPU 360 counts the number of pulses from a staple transport motor (not shown) that rotationally drives the staple discharged sheet rollers 11, so as to turn on the solenoid 170 when a predetermined number of pulses are counted. Further, according to on and off of the solenoids 170, the drum skid 12 pivots. When the solenoid 170 is turned on, the drum skid 12 strikes and returns the sheets downwardly and aligns the sheets by causing one of their edges to hit the rear end fence 51. In this way, when each of the sheets to be stacked on the stacking tray 50 is passed through the gate sensor 301 or the staple discharged sheet sensor 305, a detection signal is fed to the CPU 360 and the number of the sheets is counted.

After the solenoid 170 is turned off and a predetermined time elapses, each jogger fence 53 moves further inwardly by 2.6 millimeters and stops, according to operation of the jogger motor 158. Thereupon, the alignment in the sheet width direction is complete. Each jogger fence 53 then moves outwardly by 7.6 millimeters, and returns to each wait position to be ready for alignment of the next sheet. This operation is repeated until alignment of the sheet for the final page is complete. When the sheet for the final page is stacked on the stacking tray 50, each of the jogger fences 53 moves inwardly by 7 millimeters and stops, and the both edges of the sheet bundle are pressed to be stapled. Then, a stapling motor (not shown) operates after a predetermined lapse, and the sheet bundle is stapled by operation of the edge face stapler S1. When equal to or more than two points are designated to be stapled, the stapling process is performed for the first point, the stapler moving motor 159 is then driven, and the end face stapler S1 moves along the tailing end of the sheet to a suitable point, followed by the stapling process for the second point. When equal to or more than three points are designated, the above operation is repeated.

Upon completion of the stapling process, the discharge motor 157 is driven to drive the discharge belt 52. A discharged sheet motor (not shown) is driven to start rotation of the shift discharged sheet rollers 6 to receive the sheet bundle lifted with the discharge nails 52*a*. Further, the jogger fences 53 are controlled to move according to the size and number of sheets to be stapled. For example, when the number of sheets to be stapled is less then a predetermined number of sheets or when the size of the sheets is smaller than a predetermined size, the sheet bundle is pressed by the jogger fences 53 and transported with the tailing end of the sheet bundle hooked by the discharge nails 52*a*. Further, when a predetermined number of pulses are counted after the detection for the sheet bundle performed by a sheet detection sensor 310 or the discharge belt home position sensor 311, each of the jogger fences 53 is drawn outwardly by 2 millimeters and the constraint exerted on the sheet bundle by the jogger fences 53 is released. This predetermined pulse is set in a time period between a point of the discharge nails 52*a* coming in contact with the sheet bundle and a point of the discharge nails 52*a* passing through the leading edges of the jogger fences 53. When the number of sheets to be stapled is larger than a predetermined number or when the sheet size is larger than a predetermined size, each jogger fence 53 is withdrawn outwardly by 2 millimeters beforehand so that the sheet bundle is discharged. In the both cases, when the sheet bundle completely passes the jogger fences 53, each jogger fence 53 moves outwardly by 5 millimeters to return to each wait position to be ready for the next sheet. It is also possible to adjust the constrain exerted on the sheet bundle by varying the distance from the sheet to the jogger fences 53.

Figure 12A:
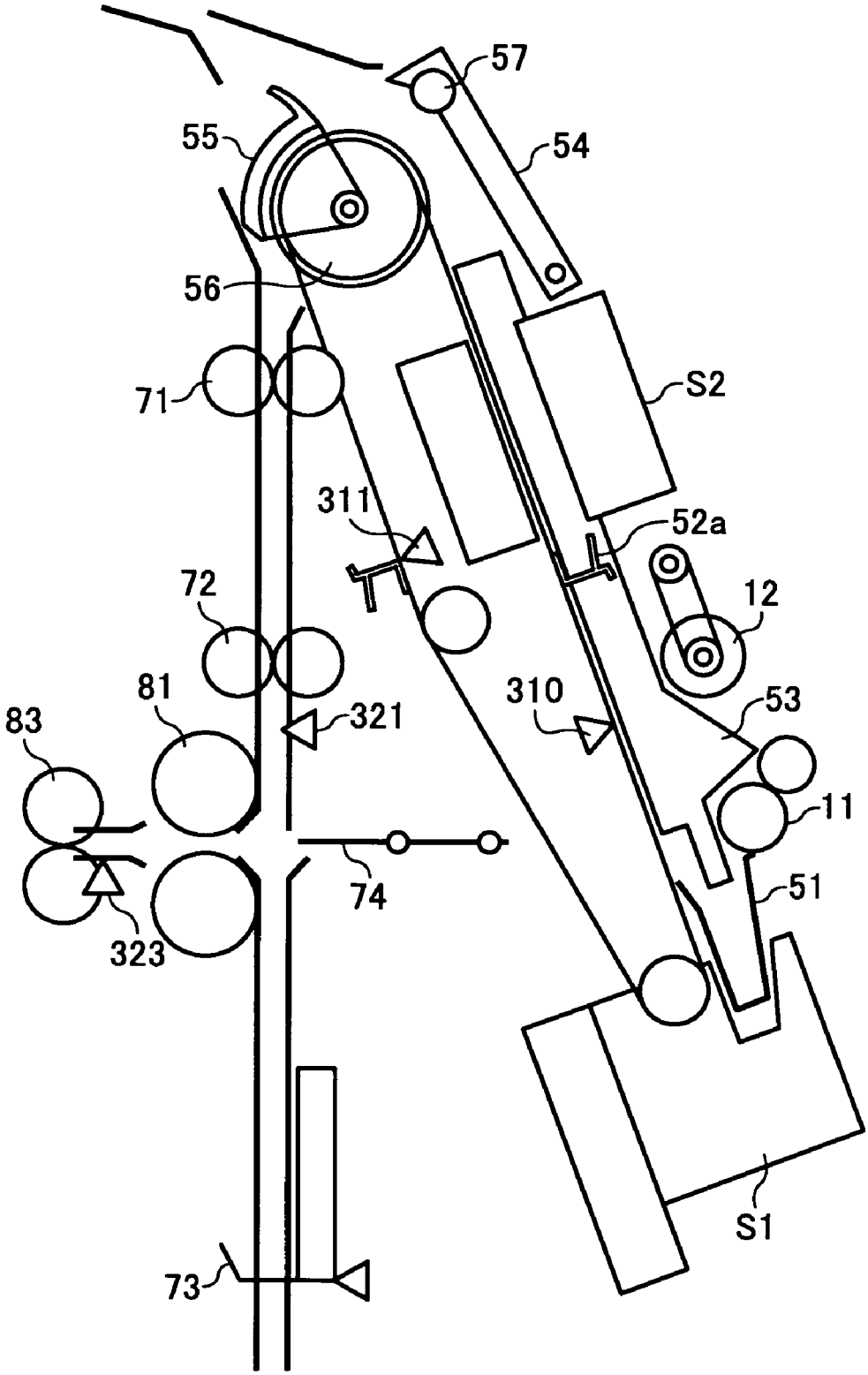
FIGS. 12A to 12I are schematic views that explain states of a sheet bundle in a saddle stitch binding mode according to the embodiment of the present invention.
Figure 12B:
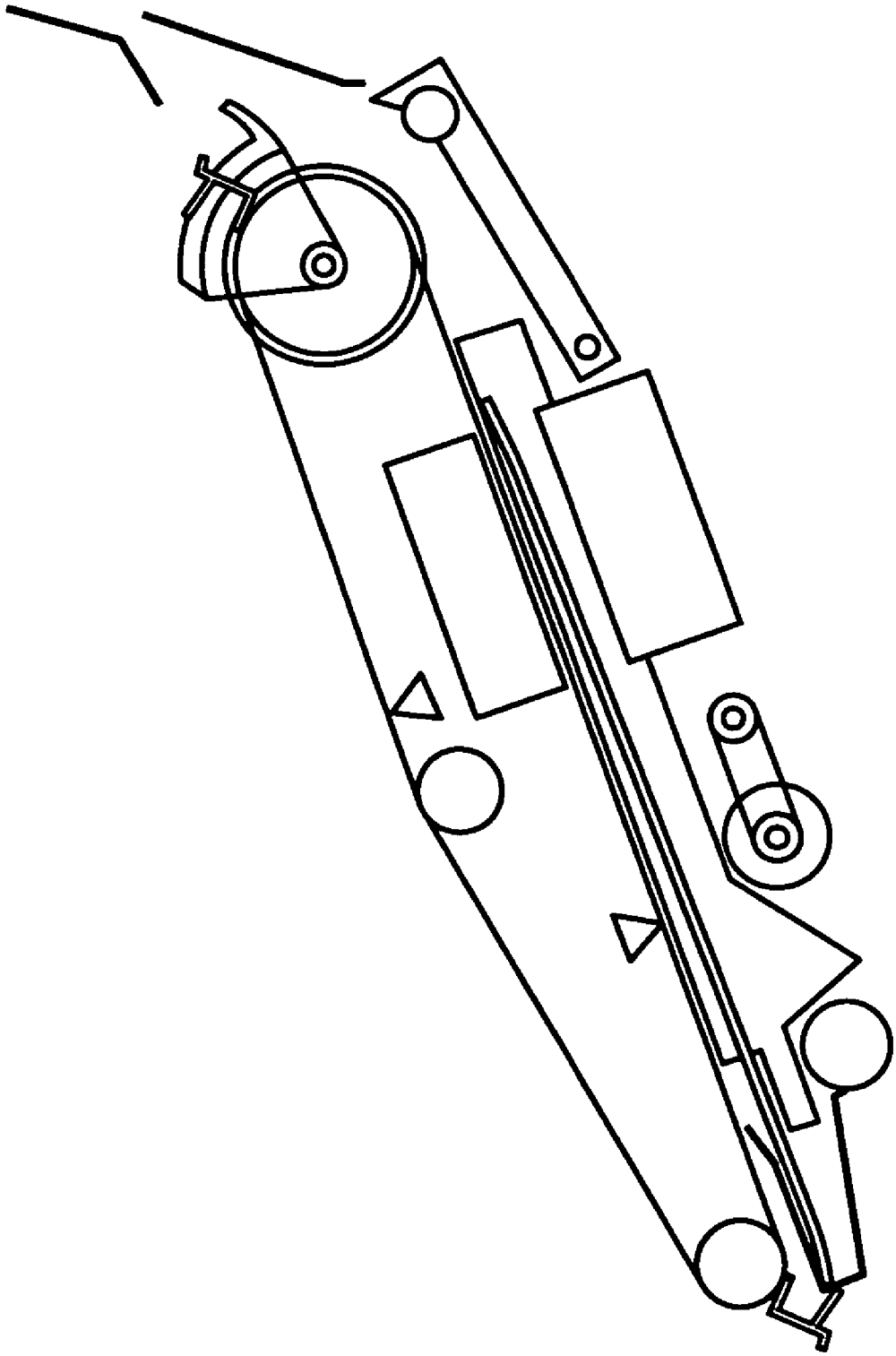
Figure 12C:
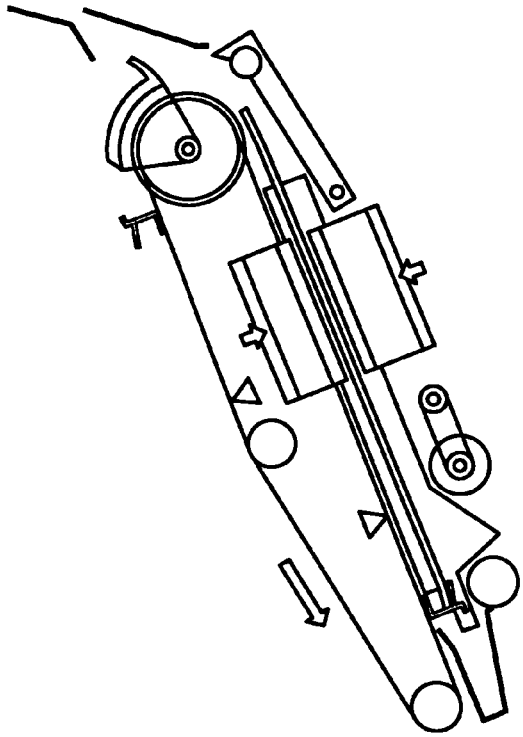
Figure 12D:
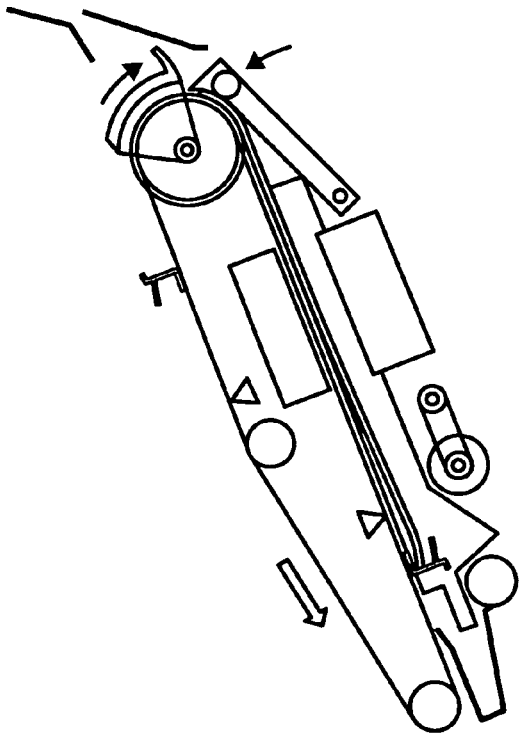
Figure 12E:
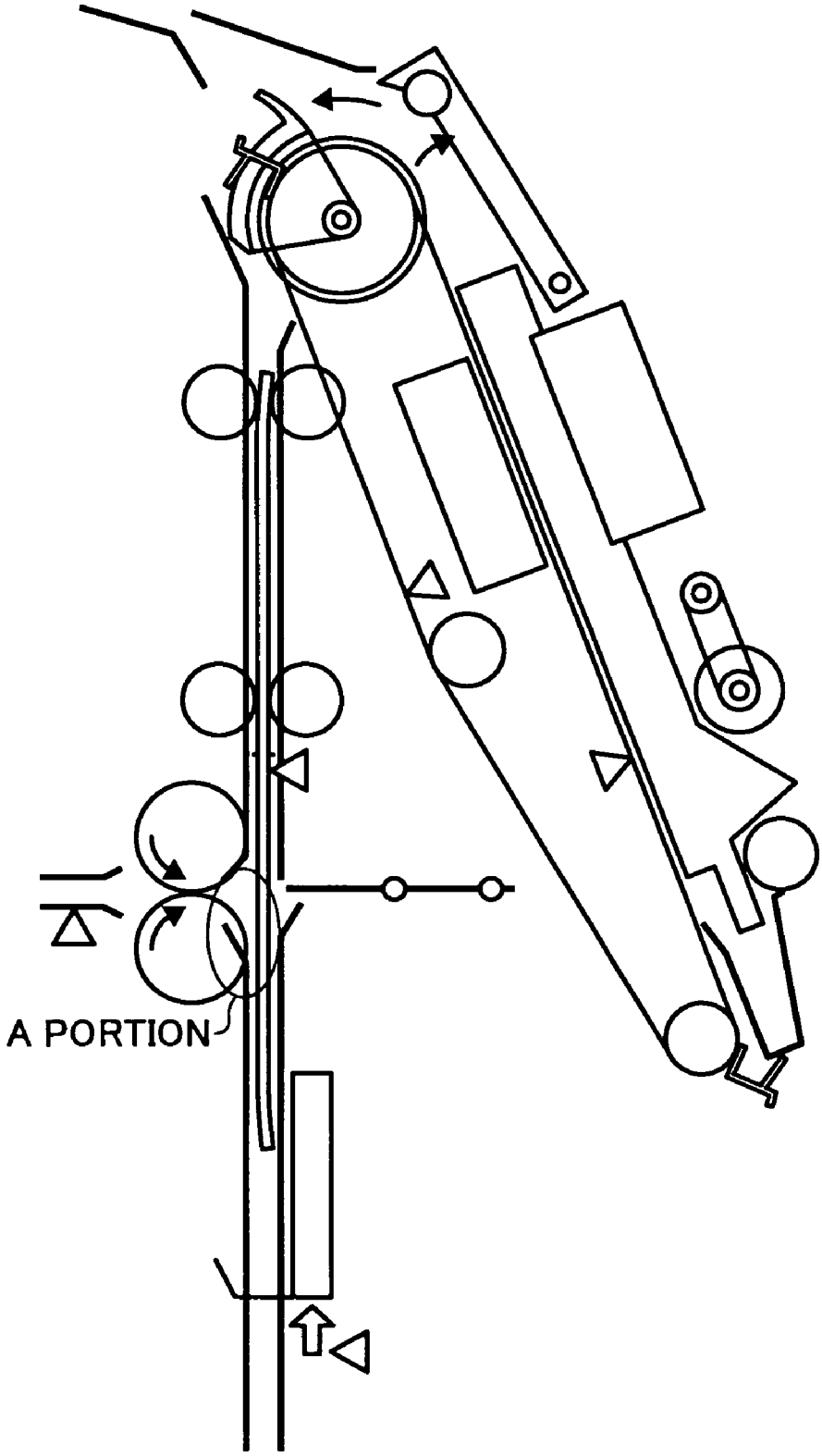

In the saddle stitch binding mode, a sheet from the transport path A is sorted with the sort nails 15 and 16, guided to the transport path D, and discharged to the processing tray F by the transport rollers 7, 9, and 10, and the staple discharged sheet rollers 11. In the processing tray F, as in the staple mode, sheets to be sequentially discharged by the staple discharged sheet rollers 11 are aligned, and the same steps as those in the staple mode are performed up until immediately before the stapling process (see FIG. 12B). The sheet bundle is then transported by the discharge nails 52*a* to the downstream by a predetermined distance set for each sheet size and positioned as shown in FIG. 12C, so that the sheets are stapled at the center portion with the saddle stitch binding stapler S2. The sheet bundle thus stapled is transported by the discharge nails 52*a* to the further downstream by a predetermined distance set for each sheet size and positioned as shown in FIG. 12D, and retained in this position for a moment. The travel distance of the sheet bundle is managed according to a drive pulse from the discharge motor 157. Further, as shown in FIG. 12D, the leading edge of the sheet bundle is caught by the discharge rollers 56 and the pressure skid 57, and then transported to the downstream again by the discharge nails 52*a* and the discharge rollers 56 so that the sheet bundle is passed to the processing tray G via a path formed by pivotal movement of the sort guide plate 54 and the movable guide 55. Further as shown in FIG. 12E, the sheet bundle is moved beforehand from its home position to a position corresponding to its size by bundle transport upper rollers 71 and bundle transport lower rollers 72, and is transported to a movable rear end fence 73 that halts to guide the lower end of the sheet bundle. The discharge nail 52*a* is halted when the other discharge nail 52*a* located opposite it reaches a position near the rear end fences 51, and the sort guide plate 54 and the movable guide 55 are recovered to their home positions to be ready for the next sheet.

Figure 12F:
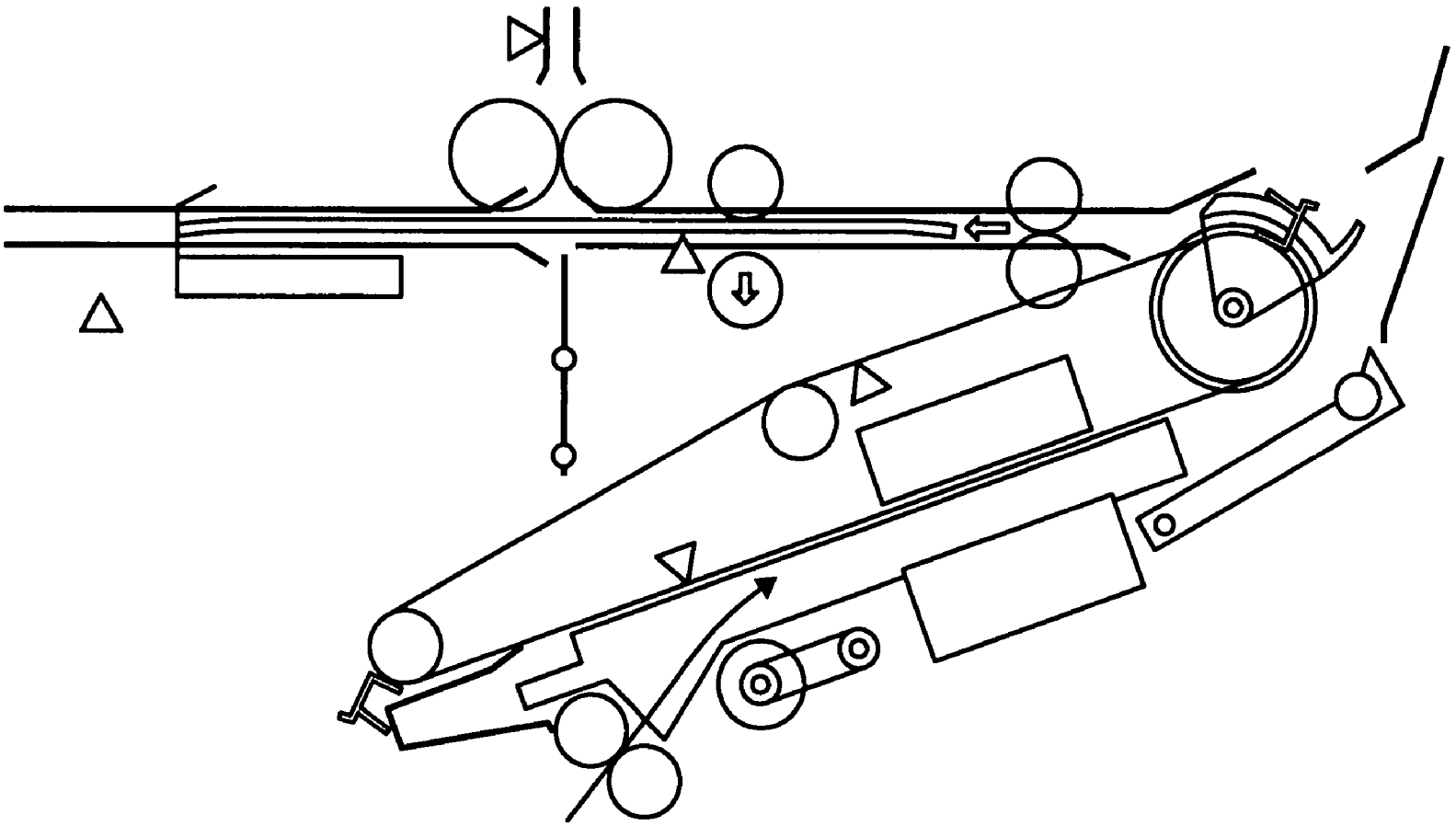
Figure 12I:
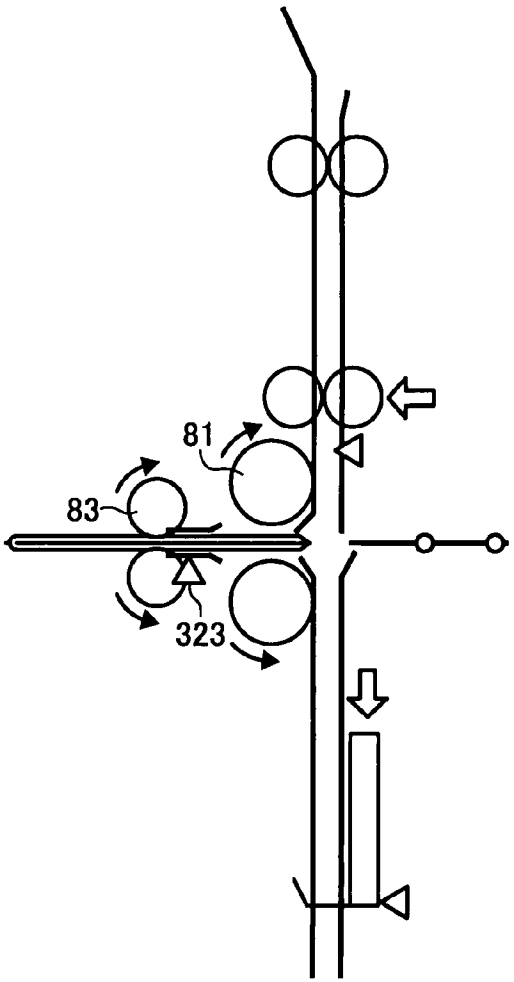
Figure 12H:
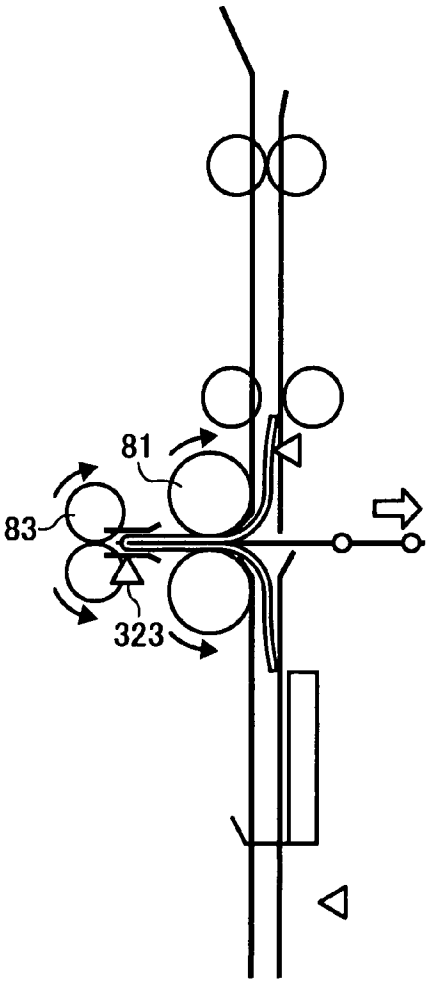
Figure 12G:
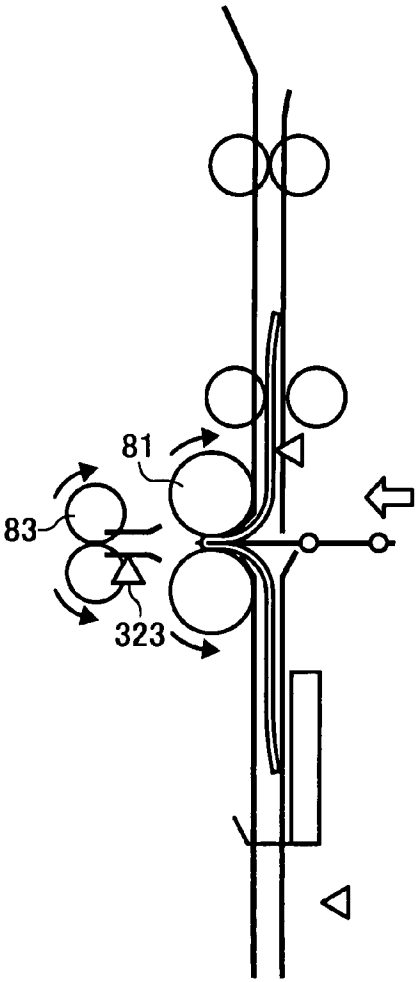
Figure 20:
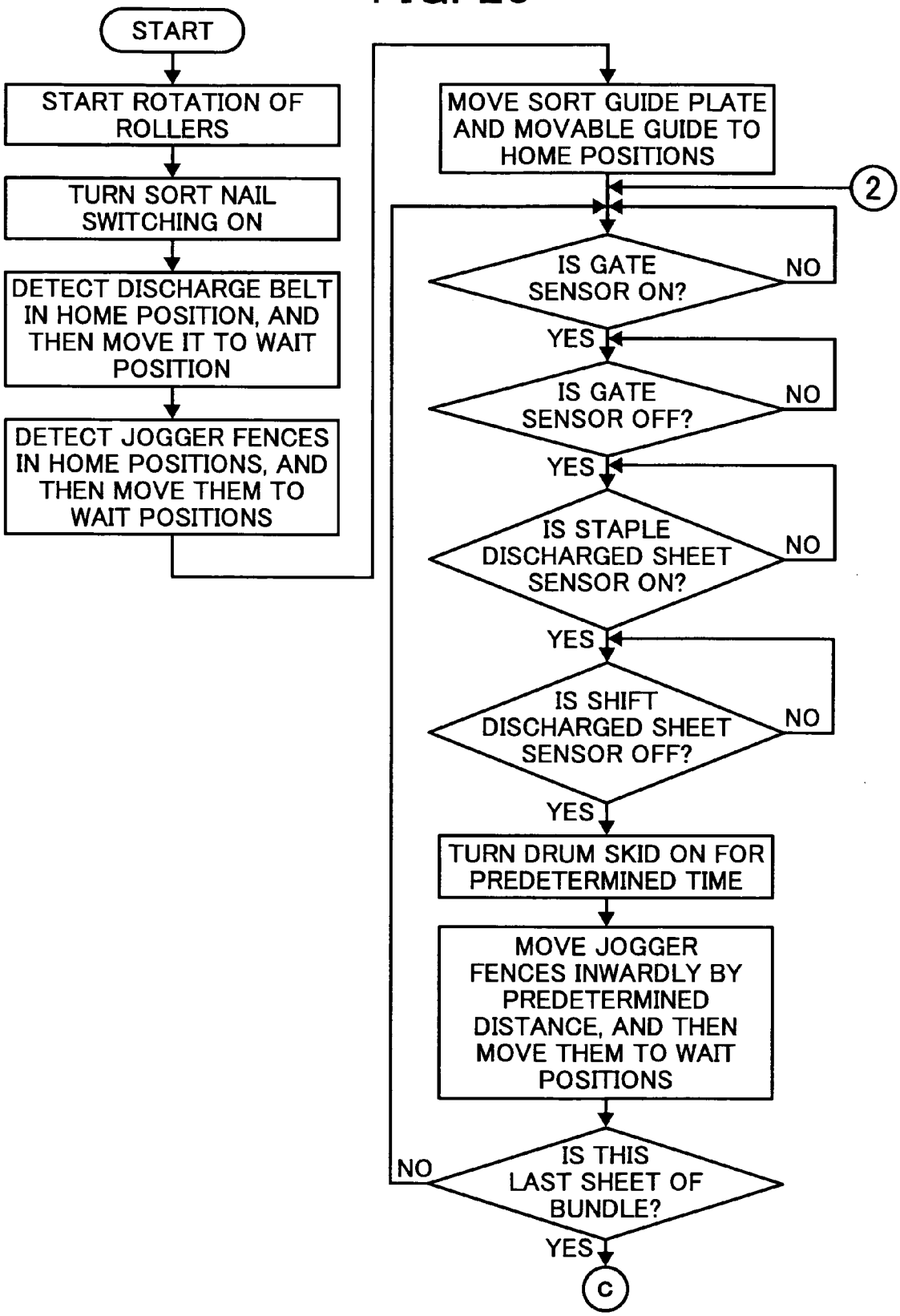
FIG. 20 is a flowchart of operations in a saddle stitch binding mode according to the embodiment of the present invention.
Figure 21:
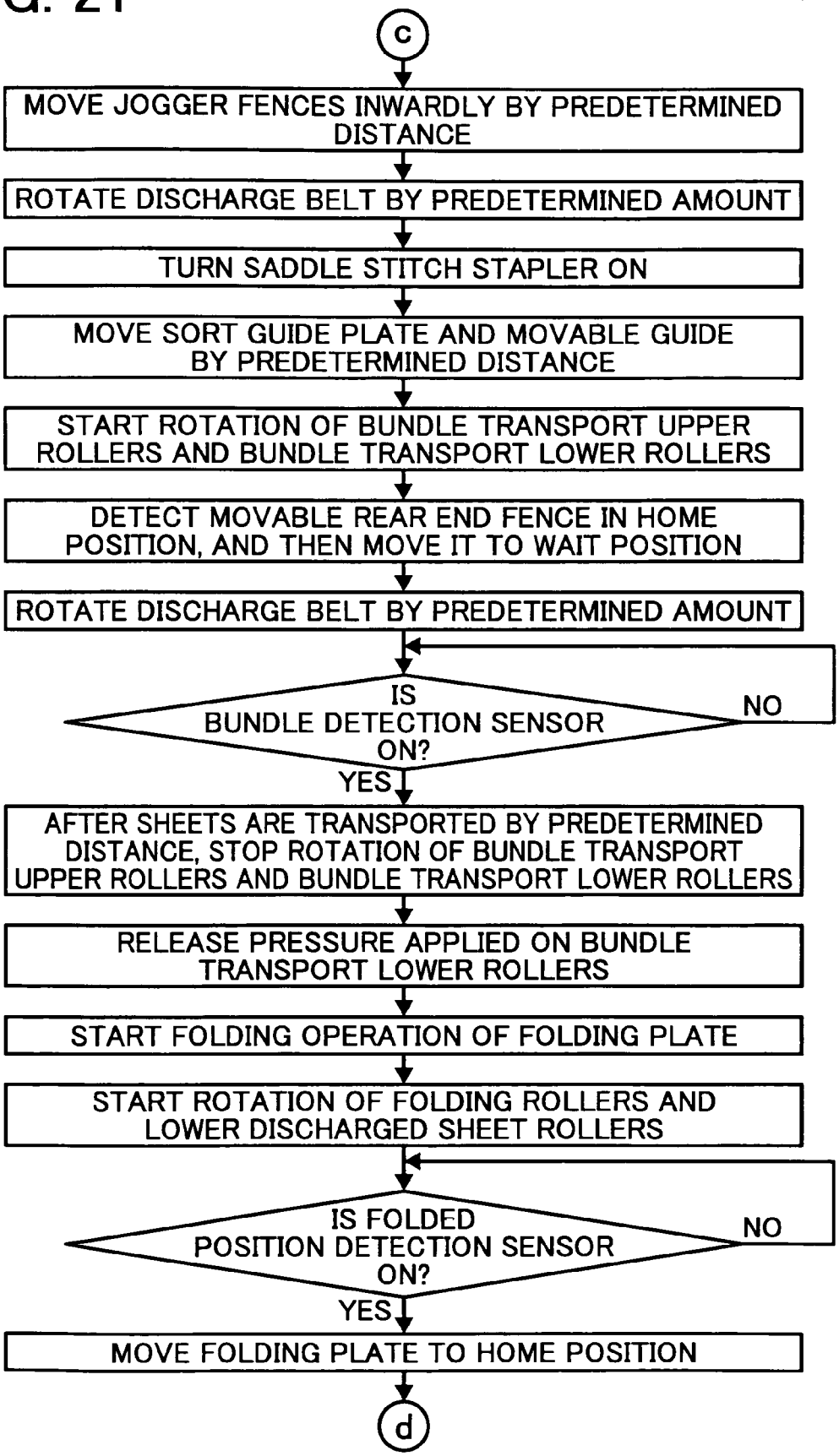
FIG. 21 is a flowchart of operations in the saddle stitch binding mode according to the embodiment of the present invention.
Figure 22:
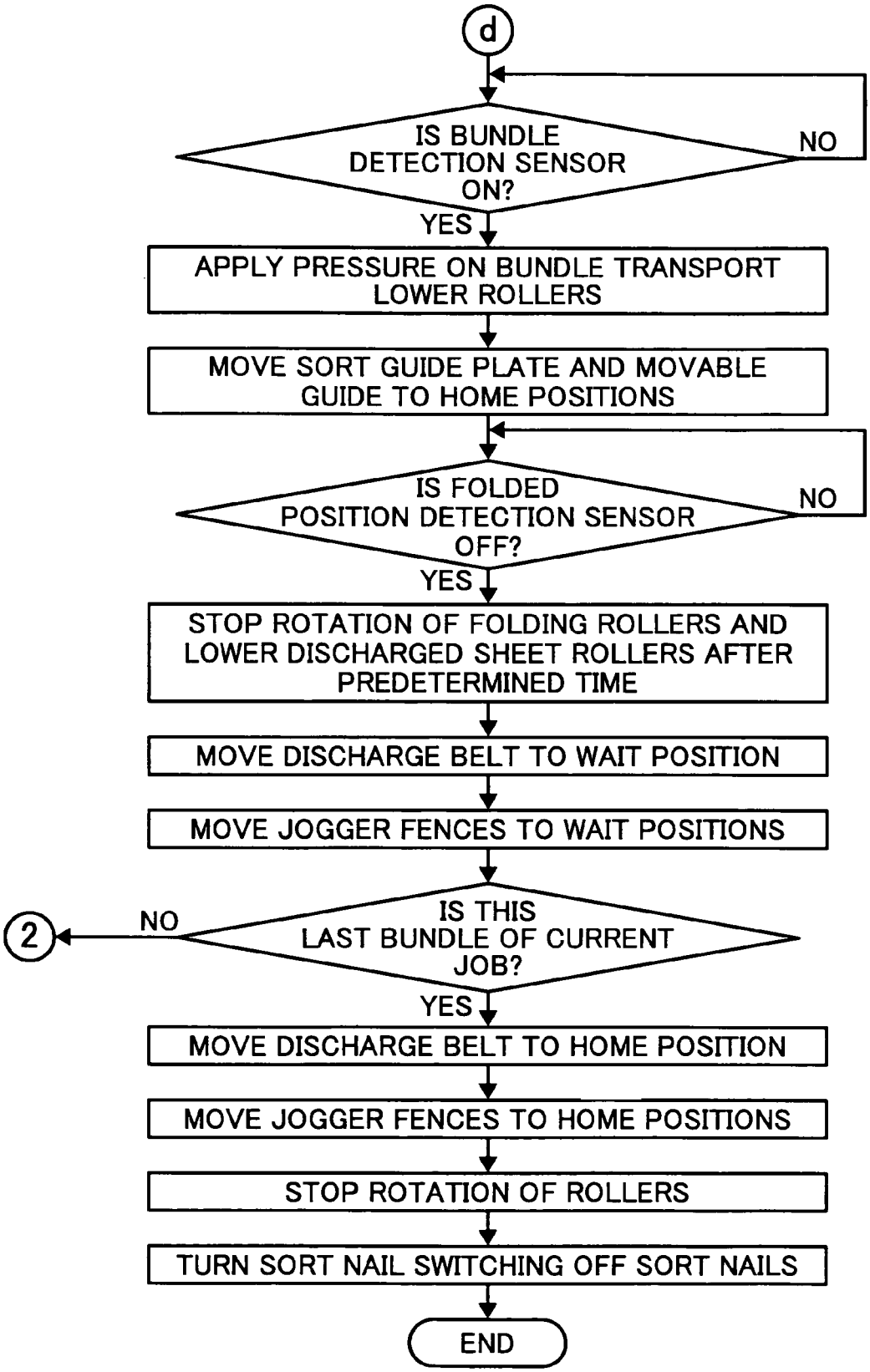
FIG. 22 is a flowchart of operations in the saddle stitch binding mode according to the embodiment of the present invention.

As shown in FIG. 12F, after release of the pressure applied by the bundle transport lower rollers 72, the sheet bundle hit to the movable rear fence 73, specifically its portion around the stapled point, is pressed in a direction almost orthogonal to the sheet by the folding plate 74 so as to be guided to the nip between the folding rollers 81 facing each other, as shown in FIG. 12G. The folding rollers 81 transport the sheet bundle while applying the pressure thereon, so as to subject the center of the sheet bundle to the folding process. As shown in FIG. 12H, when the tip of the sheet bundle thus subjected to the folding process is detected by a folded position detection sensor 323, the folding plate 74 recovers to its home position. The sheet bundle is then discharged to the lower tray 203 by the lower discharged sheet rollers 83, as shown in FIG. 12I. When the tailing edge of the sheet bundle is detected by the bundle detection sensor 321, the movable rear end fence 73 recovers to its home position and the pressure applied by the bundle transport lower rollers 72 is released to be ready for the next sheet. The movable rear end fence 73 may be arranged to retain in the position and wait if the size and number of sheets are the same also in the next job. The flow of operation in the saddle stitch binding mode is shown in FIGS. 20 to 22.

In the foregoing structure, as described in "Description of the Related Art", detecting the home positions of the jogger fences 53 with a single sensor often causes, when some malfunction occurs in the drive system that moves a side fence not detected by the sensor or when the side fences are assembled with deviation, problems in that sheets are not aligned or are stuck for some unknown reason due to no detecting unit being provided. Further, when the paired side fences are symmetrically moved by a single drive source, a significant fluctuation occurs in a gap between the side fences due to the fluctuations in dimension error of components and the shift of their installation positions, etc., with the result that sheets are not aligned or are stuck for some unknown reason in many cases.

The following describes characteristics of the present invention that solve the above problems.

Figure 23:
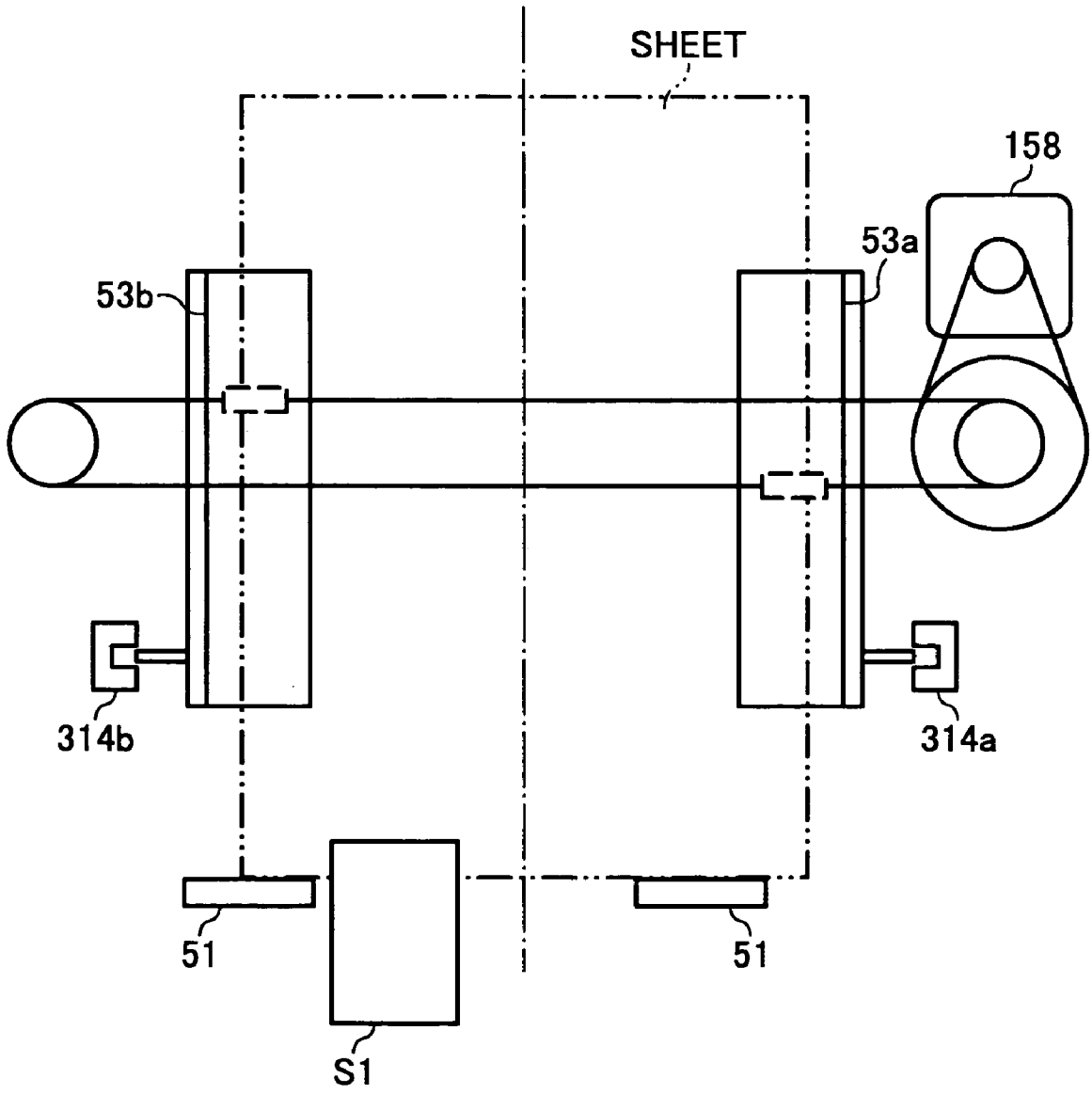
FIG. 23 is a schematic view of a jogger fence movement mechanism to which the embodiment of the present invention is applied.

In FIG. 23, jogger fences 53*a* and 53*b* move in a sheet width direction and are detected by a single jogger motor 158. In outer sides of the jogger fences 53*a* and 53*b*, jogger home position sensors 314*a* and 314*b* serving as detecting units are provided to detect home positions of the jogger fences 53*a* and 53*b*. The sensors 314*a* and 314*b* detect part of the jogger fences 53*a* and 53*b* residing in their home positions, so as to output a single to the controlling unit 350.

Figure 24:
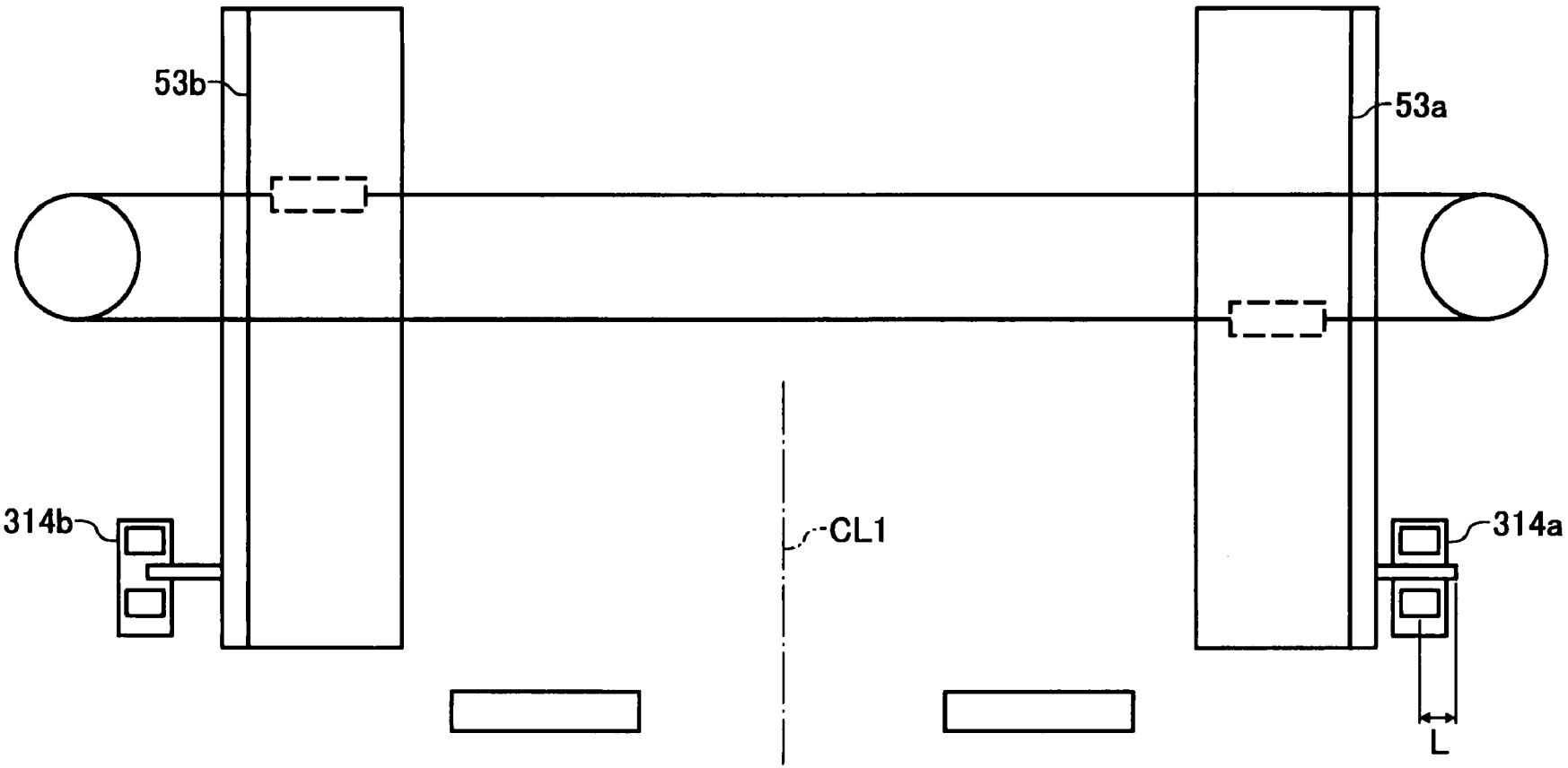
FIG. 24 is a schematic view that explains a positional deviation according to the embodiment of the present invention.

The following describes detection of the home positions of the jogger fences 53*a* and 53*b*. For example, as shown in FIG. 24, when the only jogger fence 53*a* shifts outwardly, the sensors check it and the jogger fences 53*a* and 53*b* are moved in a closing direction in which they approach to each other until both of the sensors 314*a* and 314*b* turn off. When the sensors 314*a* and 314*b* turn off, the jogger fences 53*a* and 53*b* are stopped to move. Then, the jogger fences 53*a* and 53*b* are moved in an opening direction in which they are opened. In this case, the sensor 314*a* turns on and after a while the sensor 314*b* turns on, causing a distance between the point of the sensor 314*a* turning on and the point of the sensor 314*b* turning on, i.e., a position deviation L. This position deviation L is stored in the controlling unit 350 and then the jogger fences 53*a* and 53*b* are stopped. This position at which both of the sensors 314*a* and 314*b* turn on is defined as their home position, and may also be defined at positions shifted away from this home position by an arbitrary distance (e.g. about 1 millimeters to 5 millimeters). In FIG. 24, the center line of the apparatus is indicated by CL1.

Figure 25:
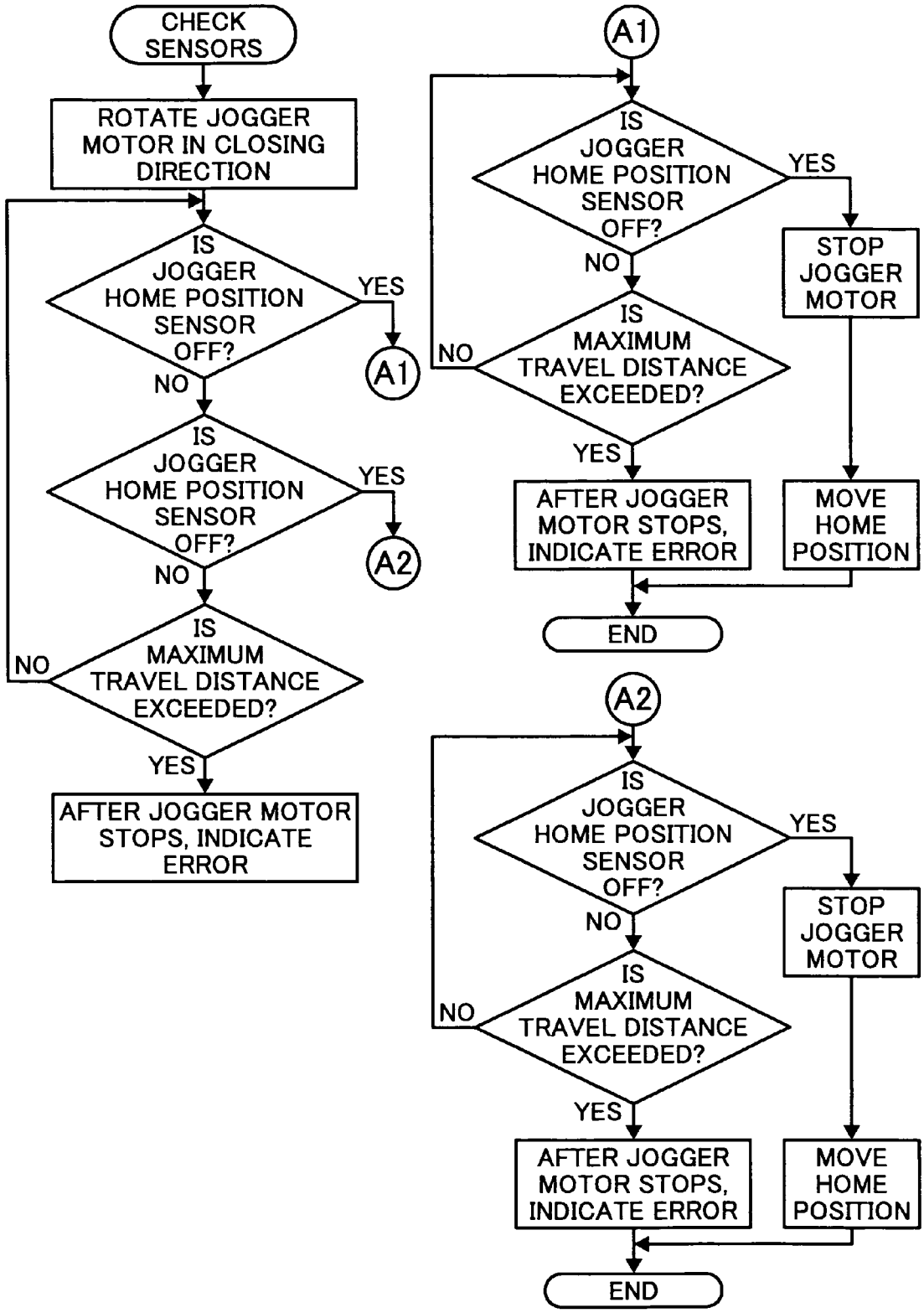
FIG. 25 is a flowchart representing a warning operation in the checking by the sensors according to the embodiment of the present invention.

As shown in the flowchart of FIG. 25, in the checking operation by the sensors, even when a signal is fed from one of the sensors and then the jogger fences 53*a* and 53*b* move by a predetermined distance, no signal fed from the other sensor is determined as a malfunction of the jogger fences due to the positional deviation L exceeding a predetermined value, with the result that an alert is issued to call for repair of the sheet post-processing apparatus 200. Examples of such a warning unit that issues an alert include buzzers, lamps, and the like that issue an alert to a user near the apparatus, and those issue an alert to maintenance personnel via a communications unit.

Figure 26A:
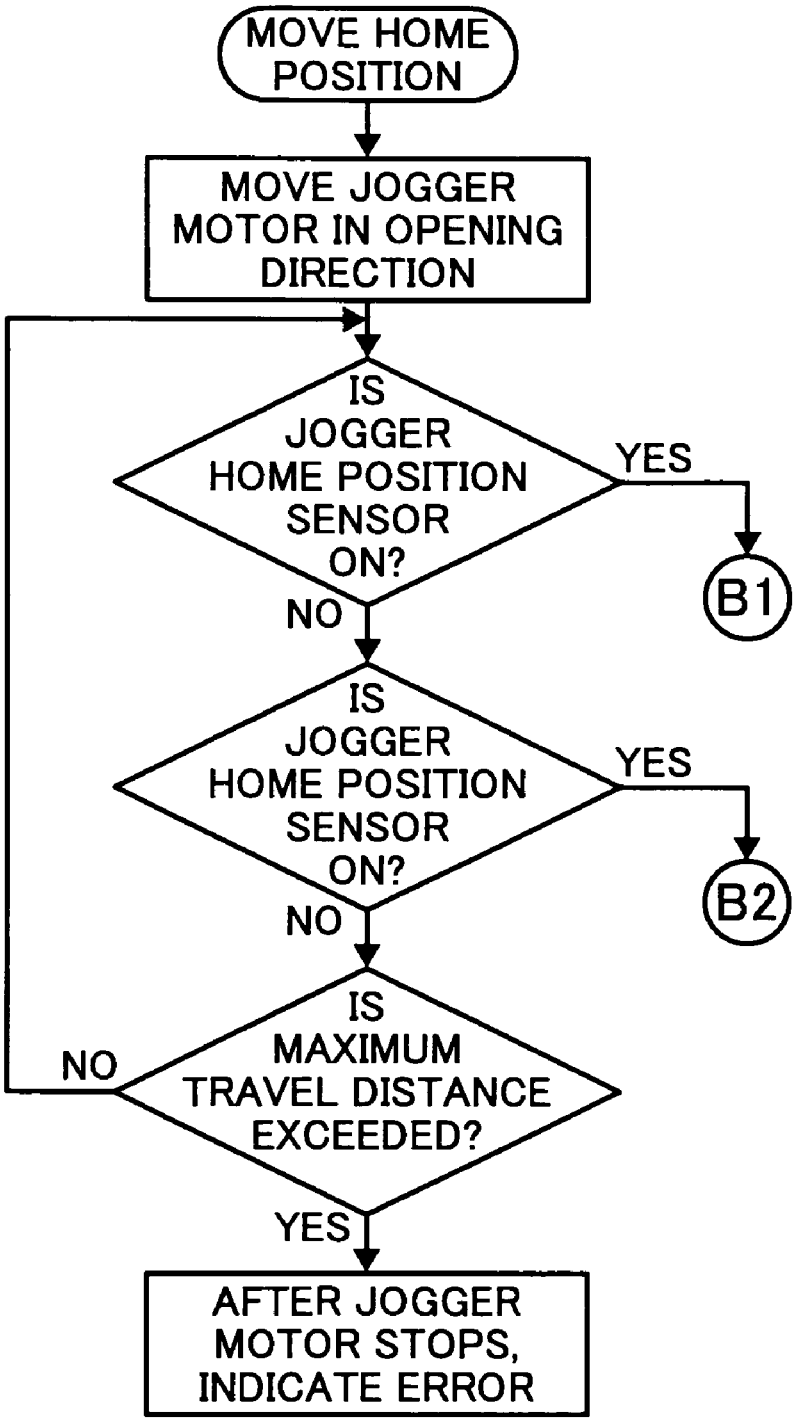
FIG. 26 is a flowchart representing a warning operation when the home positions are moved, according to the embodiment of the present invention.
Figure 26B:
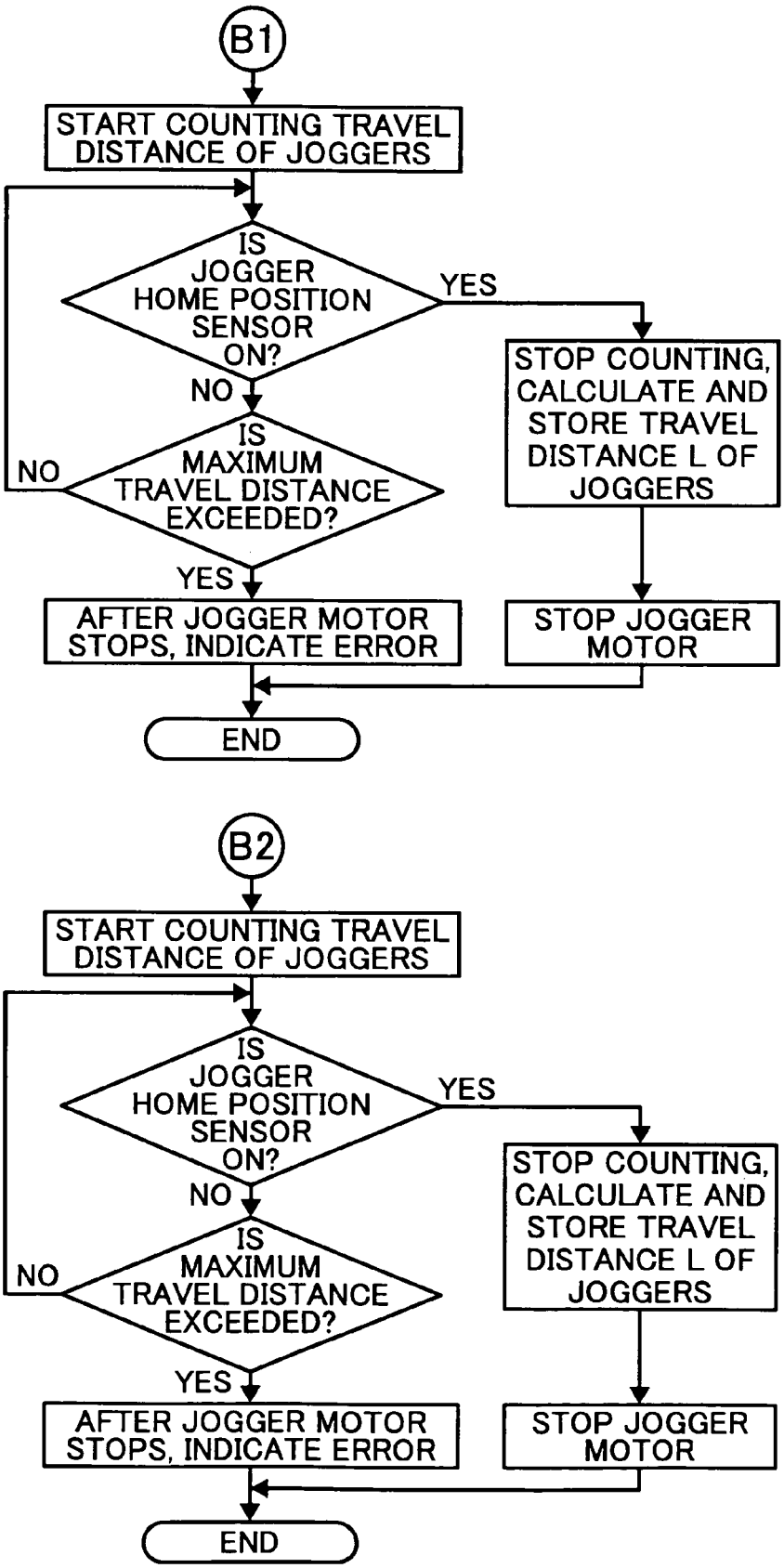

As shown in the flowchart of FIG. 26, in the operation of moving the home position, as in the checking operation by the sensors, even when a signal is fed from the one of the sensors and then the jogger fences 53*a* and 53*b* move by a predetermined distance, no signal fed from the other sensor is determined as a malfunction of the jogger fences due to the positional deviation L exceeding a predetermined value, with the result that an alert is issued to call for repair of the sheet post-processing apparatus 200. Examples of such a warning unit include buzzers and lamps that issue an alert to a user near the apparatus, and those that issue an alert to maintenance personnel via a communications unit.

This enables detection of failures in assembly of the jogger fences occurred during initial assembly or replacement of the jogger fences. Further, it is also possible to reliably detect some malfunction occurred in a drive system that moves each jogger fence, enabling to prevent such malfunction that sheets are not aligned or are stuck for some unknown reasons.

The following describes correction operation of the positional deviation detected by the sensors 314*a* and 314*b*. The description first deals with the correction performed when alignment of sheets with the jogger fences 53*a* and 53*b* is started.

Figure 27:
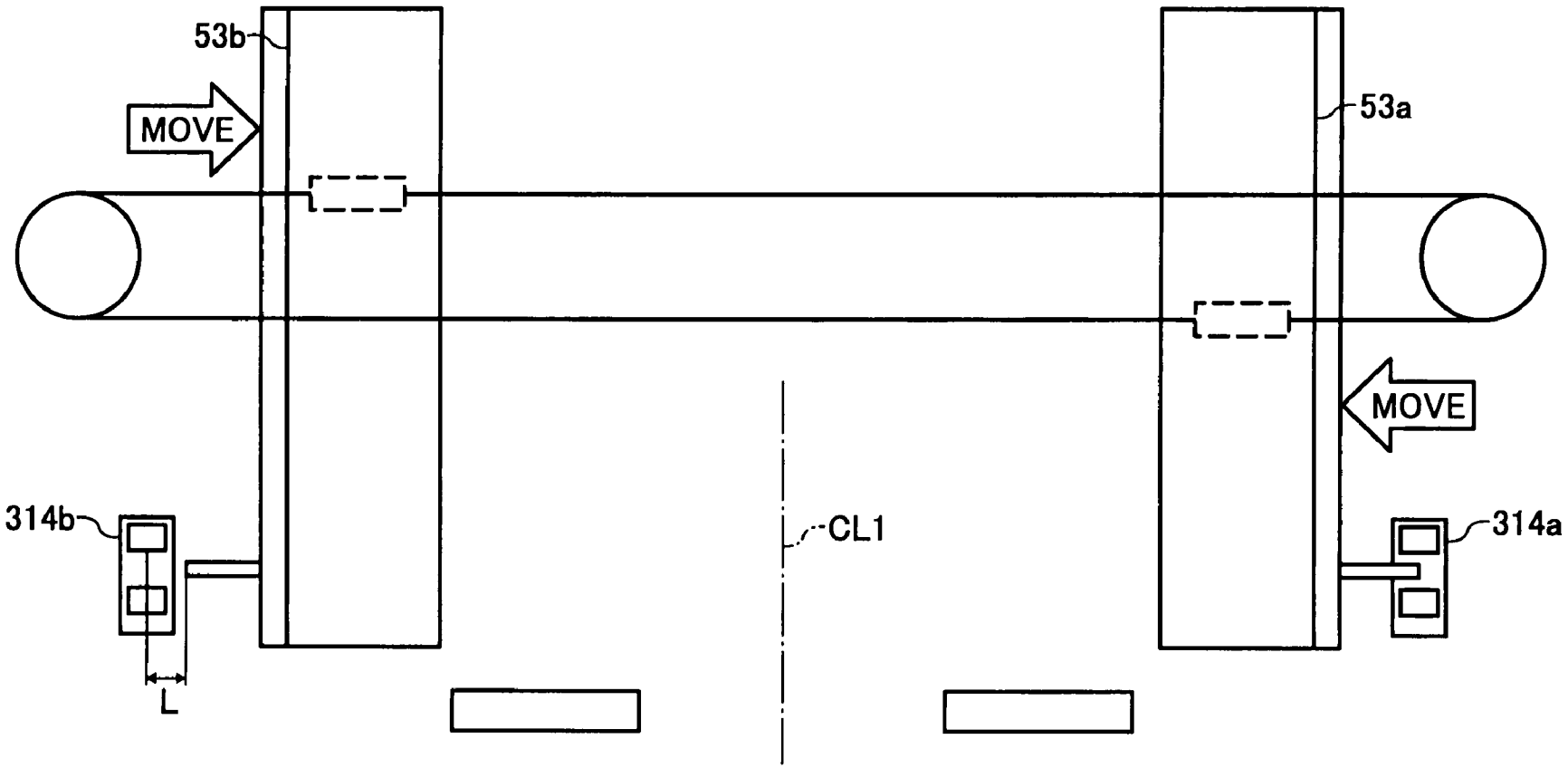
FIG. 27 is a schematic view illustrating a correction operation according to the embodiment of the present invention.

As shown in FIG. 27, when alignment of the sheets is started, the jogger fences 53*a* and 53*b* move in the closing direction in which they approach to each other. When the jogger fences 53*a* and 53*b* move from their home positions by a distance L, the sensor 314*b* turns off. During this operation, the positional deviation L may be measured and stored in the controlling unit 350. In this case, the operation for moving the home positions is simplified and completed with both the sensors 314*a* and 314*b* turned on. Further, when the jogger fences 53*a* and 53*b* are in their predetermined wait positions, they stop moving. A distance between the wait positions of the jogger fences 53*a* and 53*b* is set to be larger than the width of a sheet in use by about 10 millimeters to 16 millimeters. The correction is performed when the jogger fences 53*a* and 53*b* move from their home positions to the wait positions.

Figure 28:
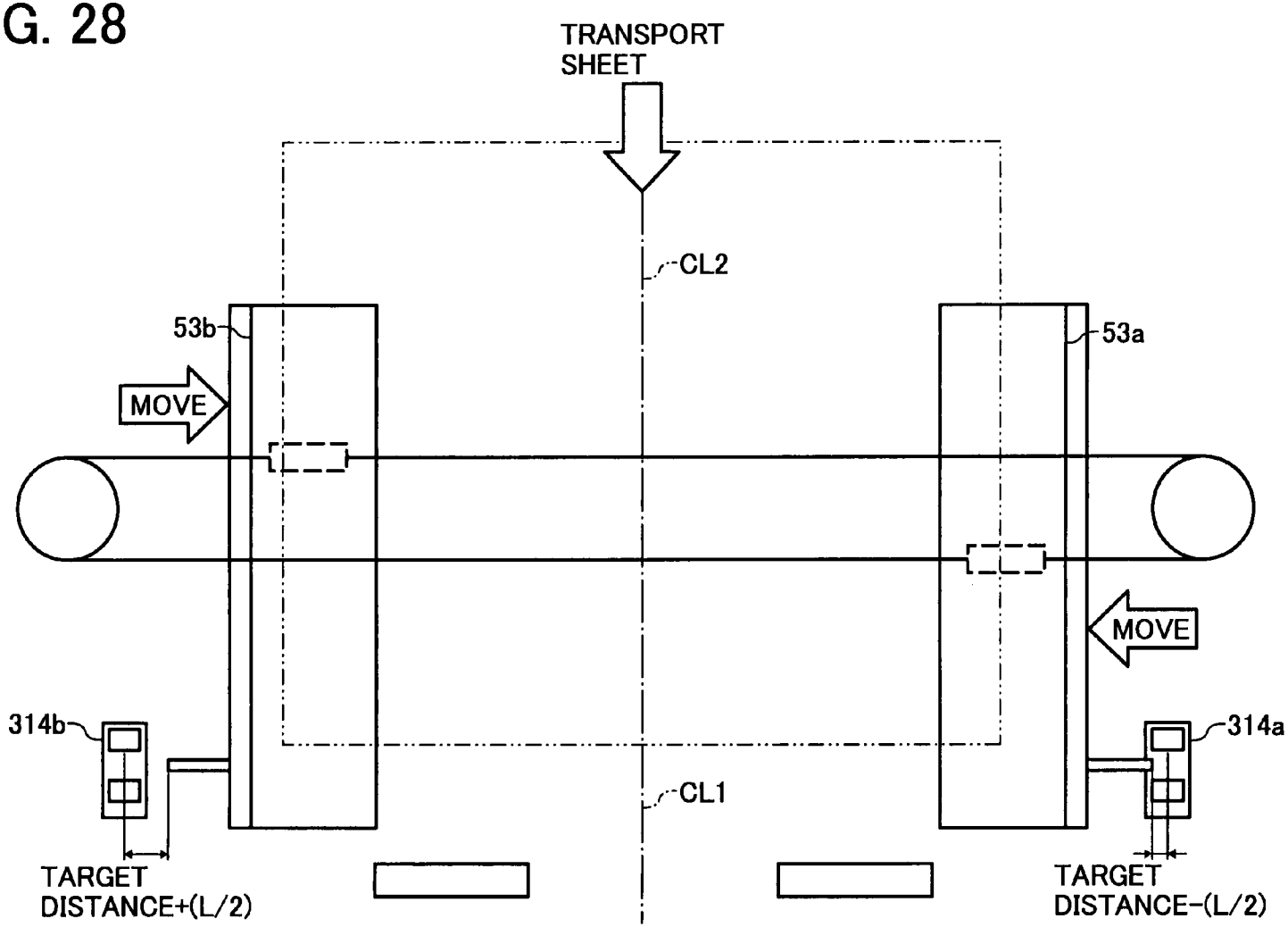
FIG. 28 is a schematic view illustrating a correction operation according to the embodiment of the present invention.
Figure 29:
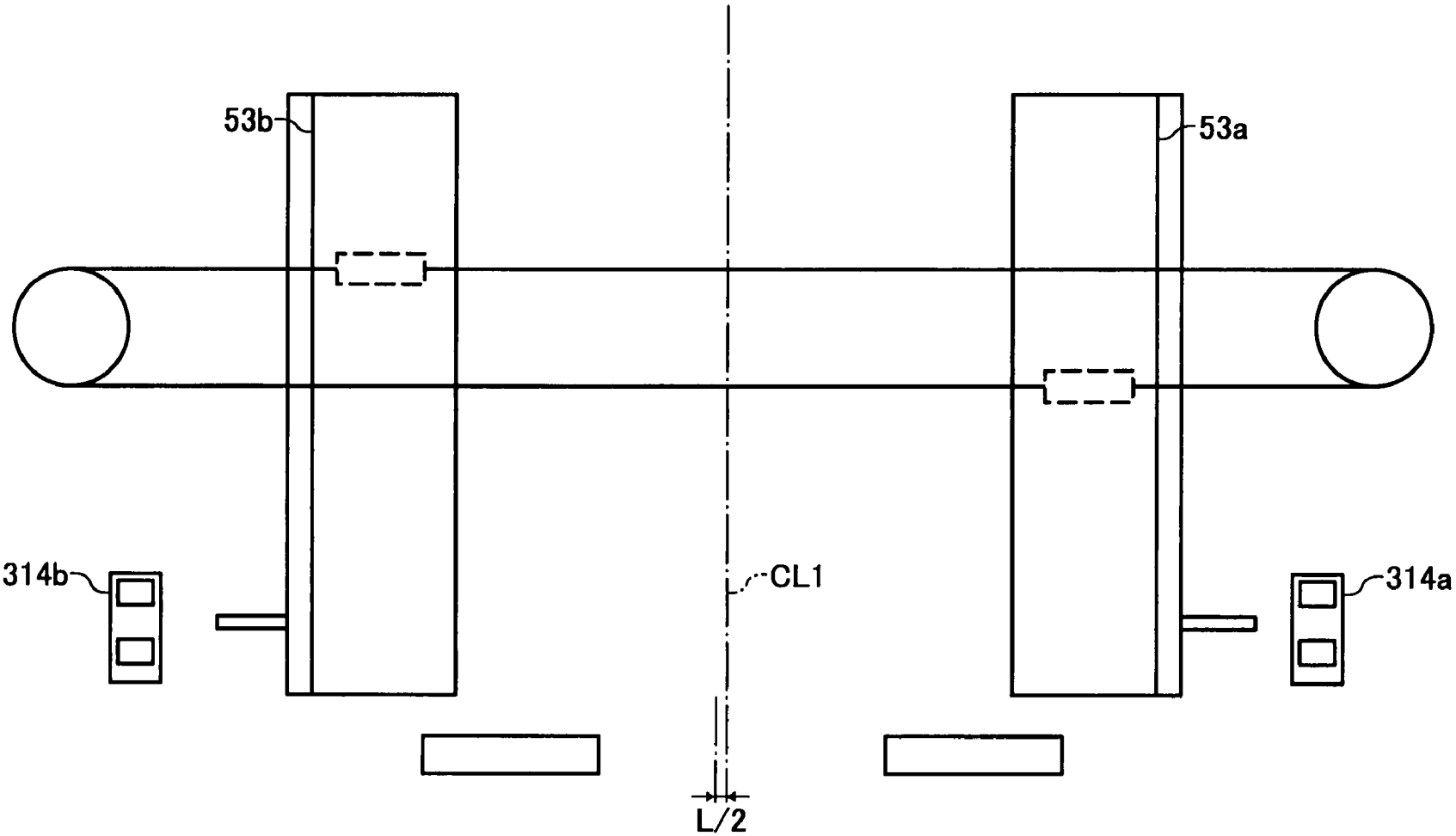
FIG. 29 is a schematic view illustrating a correction operation according to the embodiment of the present invention.

When no positional deviation occurs in the jogger fences 53*a* and 53*b*, the sensors 314*a* and 314*b* turn on at the same time. Accordingly, the jogger fences 53*a* and 53*b* may be moved by a target distance, i.e., a distance between their wait positions and either of the sensors. However, in the present embodiment, as shown in FIG. 28, a deviation occurred in the jogger fences 53*a* and 53*b* needs to be corrected. Since the sensor 314*b* first turns off when the jogger fences 53*a* and 53*b* move from their home positions, they are moved in the closing direction by the target distance and further moved by a distance of half the positional deviation L previously stored in the controlling unit 350. This enables a mean value of travel distances of the jogger fences 53*a* and 53*b* to be equal to the target distance, so that relative positions of the jogger fences 53*a* and 53*b* can be corrected although a center point CL2 between the jogger fences 53*a* and 53*b* shifts from the center line CL1 of the apparatus as shown in FIG. 29.

As to the correction, when the positional deviation L is detected at the start of the alignment of the sheets, when the jogger fences 53*a* and 53*b* move from their home positions, correction is performed by moving the jogger fences 53*a* and 53*b* by a distance that half the positional deviation L is extracted from the targeted distance, at the point when the sensor 314*b* turns off after the sensor 314*a* turns off.

Upon completion of the correction for receiving sheets, sheets are stuck between the jogger fences 53*a* and 53*b*. Then, as shown in FIG. 29, the jogger fences 53*a* and 53*b* move to their alignment positions and the sheets are aligned. The jogger fences 53*a* and 53*b* in the alignment positions are set to have a distance in between of about 1 millimeters to 2 millimeters narrower than the width of the sheets. After the sheets are aligned between the alignment positions, the jogger fences 53*a* and 53*b* again move to their wait positions to be ready for receiving the next sheets.

According to the arrangement, operation of the jogger motor 158 is controlled by the controlling unit 350 such that the jogger fence 53*b* having a delayed phase by a distance of half the positional deviation during alignment of the sheet bundle is moved further along the path. This enables correction of fluctuations in travel width of the jogger fences 53*a* and 53*b*, enabling to align the sheets by a desirable travel width.

Figure 30A:
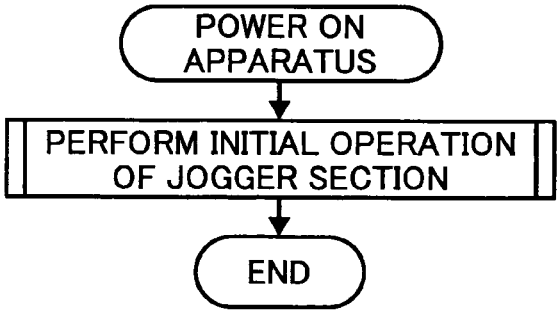
FIGS. 30A, 30B, and 30C are flowcharts representing initial operation according to the embodiment of the present invention.
Figure 30B:
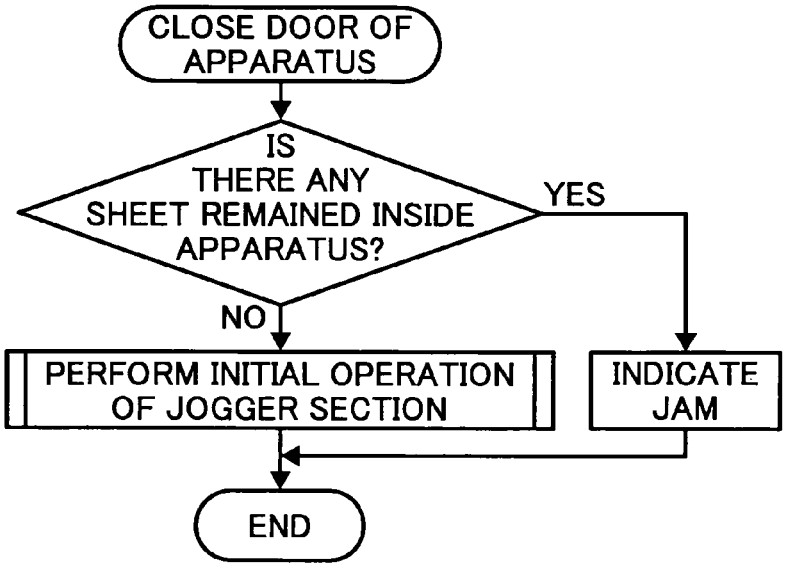
Figure 30C:
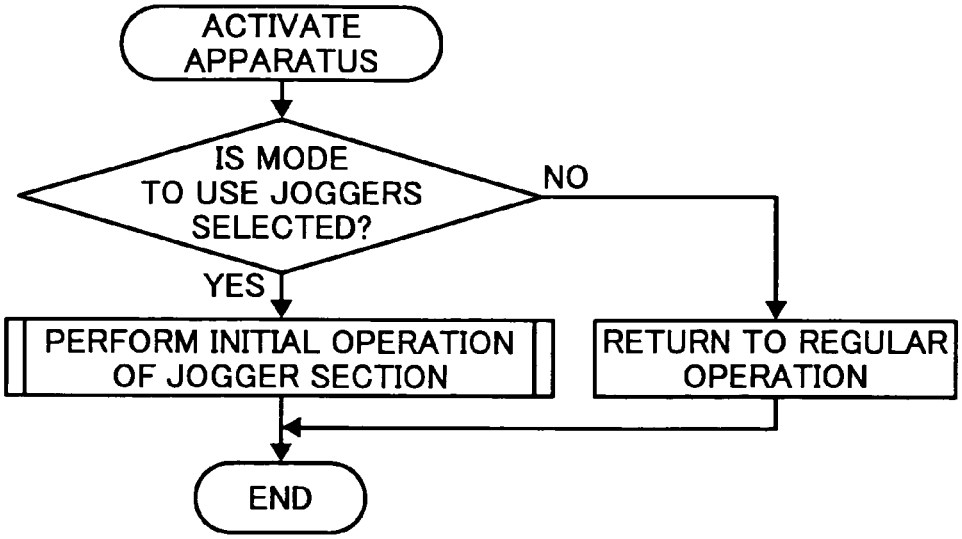

According to the arrangement, the correction by the jogger fences 53*a* and 53*b* is performed when the alignment of the sheets is started. However, the correction may be performed during initial operation of the jogger fences 53*a* and 53*b*. The initial operation is performed when the power is supplied, when jam is processed, or when a mode to use the jogger fences 53*a* and 53*b* is selected and the apparatus is activated. The operations when the power is supplied, when jam is processed, and when a mode to use the jogger fences 53*a* and 53*b* is selected and the apparatus is activated are respectively shown in the flowcharts of FIGS. 30A, 30B, and 30C.

Further, in the saddle stitch binding as described, the alignment accuracy for stapling the sheet bundle, specifically aligning the sheets in the sheet width direction, becomes more important than in stapling the end face. This provides significant advantages to be obtained when the home positions of the jogger fences 53 are managed by the sensors 314*a* and 314*b*.

According to some aspects of the present invention, failure in assembly of the side fences during the initial assembly or replacement of the side fences can be detected. Further, it is also possible to reliably detect some malfunction occurred in a drive system that moves each side fence. This prevents problems in that sheets are not aligned or are stuck for some unknown reasons.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet alignment mechanism, comprising:

a stacking tray on which a sheet or sheet bundle transported along a sheet transport path is stacked;

a pair of side fences that are movable in a sheet width direction and align edges of the sheet or sheet bundle, stacked on the stacking tray, in the sheet width direction;

a single drive source that moves the side fences;

two detecting units that detect home positions of the respective side fences, and positioned in outer sides of the respective side fences;

a controlling unit that controls movement of the side fences based on detection results by the two detecting units, and a warning unit that issues an alert in response to an amount of a positional deviation exceeding a set value, wherein the controlling unit performs correction on a relative positional deviation of the side fences shown in the detection results.

2. The sheet alignment mechanism according to claim 1, further comprising:

a standard fence that aligns an edge of the sheet or sheet bundle, stacked on the stacking tray, in a transport direction; and a stapler that staples the sheet bundle stacked on the stacking tray and aligned with the standard fence and the side fences.

3. The sheet alignment mechanism according to claim 2, wherein the stapler is a saddle stitch stapler that staples the sheet bundle at almost the center of the sheet bundle.

4. The sheet alignment mechanism according to claim 1, wherein the correction of the side fences is performed at start of the side fences' sheet alignment operation.

5. The sheet alignment mechanism according to claim 1, wherein the correction of the side fences is performed at an initial operation of the side fences.

6. The sheet alignment mechanism according to claim 5, wherein the initial operation is performed any one of at a power supply, at jam processing, and at an operational start with a mode to use the side fences being selected.

7. The sheet alignment mechanism according to claim 1, wherein the correction of the side fences is performed such that, with a positional difference between one of the side fences having an advanced phase and the other side fence having a delayed phase being defined as an amount of the positional deviation, the controlling unit controls the single drive source to bring the other side fence having the delayed phase half the amount of the positional deviation further along the path.

8. A sheet post-processing apparatus, comprising:

a sheet alignment mechanism that includes:

a stacking tray on which a sheet or sheet bundle transported along a sheet transport path is stacked;

a pair of side fences that are movable in a sheet width direction and align edges of the sheet or sheet bundle, stacked on the stacking tray, in the sheet width direction;

a single drive source that moves the side fences;

two detecting units that detect home positions of the respective side fences, and positioned in outer sides of the respective side fences; and a controlling unit that controls movement of the side fences based on detection results by the two detecting units, wherein the controlling unit performs correction on a relative positional deviation of the side fences shown in the detection results, and wherein the correction of the side fences is performed such that, with a positional difference between one of the side fences having an advanced phase and the other side fence having a delayed phase being defined as an amount of the positional deviation, the controlling unit controls the single drive source to bring the other side fence having the delayed phase half the amount of the positional deviation further along the path.

9. An image forming apparatus, comprising:

a sheet alignment mechanism that includes:

a stacking tray on which a sheet or sheet bundle transported along a sheet transport path is stacked;

a pair of side fences that are movable in a sheet width direction and align edges of the sheet or sheet bundle, stacked on the stacking tray, in the sheet width direction;

a single drive source that moves the side fences; and two detecting units that detect home positions of the respective side fences, and positioned in outer sides of the respective side fences; and a controlling unit that controls movement of the side fences based on detection results by the two detecting units, wherein the controlling unit performs correction on a relative positional deviation of the side fences shown in the detection results, and wherein the correction of the side fences is performed such that, with a positional difference between one of the side fences having an advanced phase and the other side fence having a delayed phase being defined as an amount of the positional deviation, the controlling unit controls the single drive source to bring the other side fence having the delayed phase half the amount of the positional deviation further along the path.

* * * * *